United States Patent [19]

Inaba et al.

[11] Patent Number: 4,629,034

[45] Date of Patent: Dec. 16, 1986

[54] ELEVATOR CONTROL APPARATUS

[75] Inventors: Hiromi Inaba, Katsuta; Hajime Nakashima, Hitachi; Hisakatsu Kiwaki, Katsuta; Akiteru Ueda, Toukai; Takeki Ando, Naka; Toshiaki Kurosawa, Katsuta; Yoshio Sakai, Naka, all of Japan

[73] Assignee: Hitachi, Ltd., Tokyo, Japan

[21] Appl. No.: 627,640

[22] Filed: Jul. 3, 1984

[30] Foreign Application Priority Data

Jul. 4, 1983 [JP] Japan ..... 58-121797

[51] Int. Cl.[4] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 3,785,463 | 1/1974 | Kuhl et al. | 187/29 |
| 4,319,665 | 3/1982 | Komuro et al. | 187/29 |
| 4,337,847 | 7/1982 | Schröder et al. | 187/29 |
| 4,367,811 | 1/1983 | Yoneda et al. | 187/29 |
| 4,387,436 | 6/1983 | Katayama et al. | 187/29 X |

*Primary Examiner*—Vit W. Miska
*Assistant Examiner*—W. E. Duncanson, Jr.
*Attorney, Agent, or Firm*—Antonelli, Terry & Wands

[57] ABSTRACT

In an elevator wherein an elevator cage is repeatedly run among a plurality of floors by controlling a cage driving motor in accordance with a velocity command; a floor arrival error involved when the elevator cage has arrived at the floor is detected, and the velocity command for the subsequent operation is corrected in accordance with the floor arrival error, thereby to enhance the floor arrival precision.

18 Claims, 33 Drawing Figures

FIG. 4

(A)

| RESIDUAL DISTANCE TO SCHEDULED STOPPING POSITION | REFERENCE DISTANCE -BASED VELOCITY COMMAND $VCr_1$ |
|---|---|
| $r_0$ | $VC_0$ |
| $r_1$ | $VC_1$ |
| ⋮ | ⋮ |
| $r_n$ | $VCn$ |

(B)

| FLOOR | FLOOR HEIGHT TABLE VALUE PF |
|---|---|
| 1 | $PF_1$ |
| 2 | $PF_2$ |
| ⋮ | ⋮ |
| m | PFm |

(C)

| |
|---|
| LOAD L |
| MOTOR TEMPERATURE TE |
| STOPPING FLOOR FN |
| RUNNING DIRECTION ED |
| PRESENT POSITION PS |
| RESIDUAL DISTANCE r |
| FLOOR ARRIVAL ERROR d |
| FLOOR ARRIVAL VELOCITY $v_L$ |
| FLOOR ARRIVAL TIME t |
| REFERENCE FLOOR ARRIVAL VELOCITY $V_B$ |
| ALLOWABLE VELOCITY ERROR $\Delta v$ |
| REFERENCE FLOOR ARRIVAL TIME $t_B$ |
| ALLOWABLE TIME ERROR $\Delta t$ |

| |
|---|
| VELOCITY V |
| REFERENCE DISTANCE -BASED VELOCITY COMMAND $VCr_1$ |
| DISTANCE-BASED VELOCITY COMMAND VCr |
| TIME BASED VELOCITY COMMAND VCt |
| VELOCITY COMMAND VC |
| VELOCITY DEVIATION $\Delta V_{CR}$ |
| $D_L$ |
| $D_F$ |
| $D_T$ |
| $\delta_L$ |
| $\delta_F$ |
| $\delta_T$ |
| $\delta_1$ |
| $\delta_2$ |

| |
|---|
| $\delta_3$ |
| VELOCITY COMMAND CORRECTION MAGNITUDE S |
| FIXED MAGNITUDE $\Delta S$ |
| CONTROL CONSTANT CORRECTION MAGNITUDE P |
| SCFLAG |
| FLAG |
| APPARENT RESIDUAL DISTANCE r' |
| INITIALIZED PROPORTION GAIN $K_P$ |
| PROPORTION GAIN $K_{P'}$ |
| INTEGRAL GAIN $K_I$ |
| TORQUE COMMAND INTEGRAL TERM $\tau_{CC}$ |
| TORQUE COMMAND $\tau_C$ |
| SAMPLING PERIOD $t_S$ |
| FIXED DISTANCE a |

FIG. 12

| | LOAD SORTING | VELOCITY COMMAND CORRECTION MAGNITUDE |
|---|---|---|
| RUNNING DIRECTION | $0 \leqq \text{LOAD} < \Delta\ell$ | $S_1$ |
| | $\Delta\ell \leqq \text{LOAD} < 2\Delta\ell$ | $S_2$ |
| | $2\Delta\ell \leqq \text{LOAD} < 3\Delta\ell$ | $S_3$ |
| | ⋮ | ⋮ |
| ASCENT | $i\Delta\ell \leqq \text{LOAD} < (i+1)\Delta\ell$ | $S_{i+1}$ |
| | ⋮ | ⋮ |
| | $(n-1)\Delta\ell \leqq \text{LOAD} \leqq n\Delta\ell$ | $S_n$ |

FIG. 13

| RUNNING DIRECTION | LOAD SORTING \ STOPPING FLOOR | 1 | 2 | ---------- | m |
|---|---|---|---|---|---|
| ASCENT | $0 \leqq LOAD < \Delta\ell$ | $S_{11}$ | $S_{12}$ | ---------- | $S_{1m}$ |
| | ---------- | ---------- | ---------- | ---------- | ---------- |
| | $(n-1)\Delta\ell \leqq LOAD \leqq n\Delta\ell$ | $S_{n1}$ | $S_{n2}$ | ---------- | $S_{nm}$ |

ELEVATOR CONTROL APPARATUS

BACKGROUND OF THE INVENTION

The present invention relates to elevators, and more particularly to an apparatus well-suited for controlling a D.C. or A.C. elevator or a hydraulic elevator.

In general, elevators can be classified depending upon their drivers, into a D.C. or A.C. elevator which employs a D.C. or A.C. motor and a hydraulic elevator which is driven through a hydraulic mechanism by an electric motor. Further, depending upon their uses, they can be classified into a passenger elevator, a freight elevator, an automobile elevator and any other special elevator.

Since any of these elevators has the peculiar property of being for controlling vertical traffic, importance is attached to the precision of floor arrival besides the safety. In the case of the elevator, an inferior floor arrival precision appears as the vertical difference or level difference between a floor and a cage, and the difference hinders getting on and off.

In order to attain a high floor arrival precision, there has been usually adopted a system wherein during deceleration, the driving motor is controlled using as a desired control value a velocity command which is determined by the relationship between a distance to a target stopping position and a velocity.

With this system, however, it is difficult to attain a satisfactory floor arrival precision, and many improvements have been proposed and adopted.

As a typical one of them, a system wherein the position of the cage is directly and continuously detected near a stopping floor, and wherein the cage is operated at a small velocity on the basis of the detected position in the vicinity of the stopping position has been adopted for a long time especially in the D.C. elevator.

Regarding the A.C. elevator in which it is difficult to generate such a small velocity, it has been known to adjust the deceleration starting point of the elevator in dependence upon the load of the cage because this load affects the floor arrival precision. Besides, it has been proposed in the specification of U.S. Pat. No. 4,319,665 that a braking or driving torque corresponding to the load is generated in the vicinity of the stopping position, thereby to make more improvements.

Regarding the hydraulic elevator, as has been known from the specification of U.S. Pat. No. 3,530,958 by way of example, the floor arrival precision fluctuates greatly depending upon the temperature of oil, and hence, an improvement keeping the oil temperature constant is made.

Meanwhile, in recent elevator controls employing a digital computer, it has become possible to detect the position of the cage by counting pulses which are generated in proportion to the travel of the cage, and it has become possible to expect more enhancement in the floor arrival precision. In such system, the detection precisions of the cage position and each floor position have direct influence on the floor arrival precision, and it is therefore desired to enhance the detection precisions. As one of such improvements the specification of U.S. Pat. No. 4,387,436 has proposed a system wherein using a digital computer, the position of a cage is detected without being affected by the wear of an equipment or the elongation of a rope, whereupon an elevator is controlled. In addition, the specification of U.S. Pat. No. 4,367,811 has proposed a system wherein the position of each floor is detected at high precision, and an elevator is controlled using the floor position and a cage position which is obtained by counting the pulses.

All the elevators have been improved in the floor arrival precision by these systems, but more improvements are desired in view of the importance thereof.

SUMMARY OF THE INVENTION

The principal object of the present invention is to provide, in an elevator which is driven by the use of an electric motor, and an elevator control apparatus which can enhance the floor arrival performance of an elevator cage.

The present invention consists principally in an elevator wherein an elevator driving motor is controlled in accordance with a desired control value, to repeat traveling between a plurality of floors, characterized by a construction wherein the floor arrival control error of a cage till the stoppage thereof since the initiation of deceleration, which affects a floor arrival precision, is detected, and during the travel after the floor arrival, the desired control value or any control element of the motor is set in accordance with the floor arrival control error.

Thus, in the elevator the floor arrival precision of which is insufficient, the control error can be reflected upon the subsequent running, so that the floor arrival precision can be enhanced. Stated conversely, even when a floor arrival error has developed at the installation of the elevator, it is improved by repeating the running, and hence, the simplification of adjustments therefor can be expected.

In addition, in the elevator which attains a high floor arrival precision owing to the small velocity running function, it is possible to shorten the period of time for adjusting a cage position based on the small velocity running. For example, in a case where the elevator travels for one floor section, the period of time of the small velocity running can amount to about 40%. This period of time can be shortened, and power consumption required for the running (about 10% of the whole power consumption) can be saved.

The floor arrival control error is a control error which develops between the initiation of deceleration and the stoppage of the cage, and which can be detected by the element of position, velocity or time or the combination thereof as will be described in detail later.

It is also considered that the floor arrival control error will fluctuate due to such factors as the load of the cage, a running direction, a stopping floor, and a temperature. It is accordingly considered to make more improvements by setting desired control values or control elements for the respective factors fluctuating the floor arrival control error. These contrivances will be described in detail in embodiments to be stated below.

BRIEF DESCRIPTION OF THE DRAWINGS

FIGS. 1 to 19 serve to elucidate one embodiment of the present invention, wherein FIG. 1 is a general constructional view of a case where the invention is applied to a D.C. elevator, FIG. 2 is a diagram of the relationship between the velocity c and the velocity of an elevator, FIG. 3 is a diagram for explaining the operating principle of one embodiment, FIG. 4 is a memory map of the present embodiment, FIG. 5 is a basic flow chart of the present embodiment for motor control, FIG. 6 is a schematic flow chart of learning on a floor arrival error, FIG. 7 is a detailed flow chart of floor arrival error detection, FIG. 8 is a detailed flow chart of the preparation of a floor arrival data table, FIG. 9 is the floor arrival data table, FIG. 10 is a detailed flow chart of statistic processing (factor analysis) concerning floor arrival data, FIG. 11 is a velocity command amendment magnitude table concerning four factors, FIG. 12 is a velocity command amendment magnitude table concerning two factors, FIG. 13 is a velocity command amendment magnitude table concerning three factors, FIG. 14 is a detailed flow chart of conversion into the velocity command amendment magnitude table concerning two factors, FIG. 15 is a detailed flow chart of conversion into the velocity command amendment magnitude table concerning three factors, FIG. 16 is a detailed flow chart of the calculation of the velocity command amendment magnitude, FIG. 17 is a detailed flow chart of storage into the velocity command amendment magnitude table concerning two factors, FIG. 18 is a detailed flow chart of storage into the velocity command amendment magnitude table concerning three factors, and FIG. 19 is a detailed flow chart of velocity command generation using the velocity command amendment magnitude; and FIGS. 20 to 33 serve to elucidate another embodiment of the present invention, wherein FIG. 20 is a detailed flow chart for learning on the floor arrival error, FIG. 21 is another detailed flow chart for the learning on the floor arrival error, FIG. 22 is still another detailed flow chart for the learning on the floor arrival error, FIG. 23 is a detailed flow chart of the statistic processing of an evaluated velocity command, FIG. 24 is a velocity command amendment magnitude table for an individual floor arrival control error fluctuating factor.

FIG. 25 is a detailed flow chart of velocity command generation using the velocity command amendment magnitude, FIG. 26 is a diagram of the relationship between the velocity at passage through a fixed point and the floor arrival error, FIG. 27 is a schematic flow chart for motor control employing a floor arrival velocity, FIG. 28 is a detailed flow chart of learning on the floor arrival velocity, FIG. 29 is a diagram of the relationship between the period of time after passage through a fixed point and the floor arrival error, FIG. 30 is a schematic flow chart for motor control employing a floor arrival time, FIG. 31 is a detailed flow chart of learning on the floor arrival time, FIG. 32 is a schematic flow chart in the case of amending a control constant, and FIG. 33 is a detailed flow chart of torque command generation using a control constant amendment magnitude.

DESCRIPTION OF THE PREFERRED EMBODIMENT

Now, the present invention will be described in detail in conjunction with an illustrated embodiment.

Although the D.C. elevator will be described as an example here, the invention can be similarly performed for the A.C. elevator and also for the hydraulic elevator.

In the embodiment, the case of employing a digital computer will be exemplified, and the general hardware construction, the operating principles, and the software construction for realizing the operations will be described in succession. Lastly, software constructions according to the other embodiments will be described.

Figure 1:
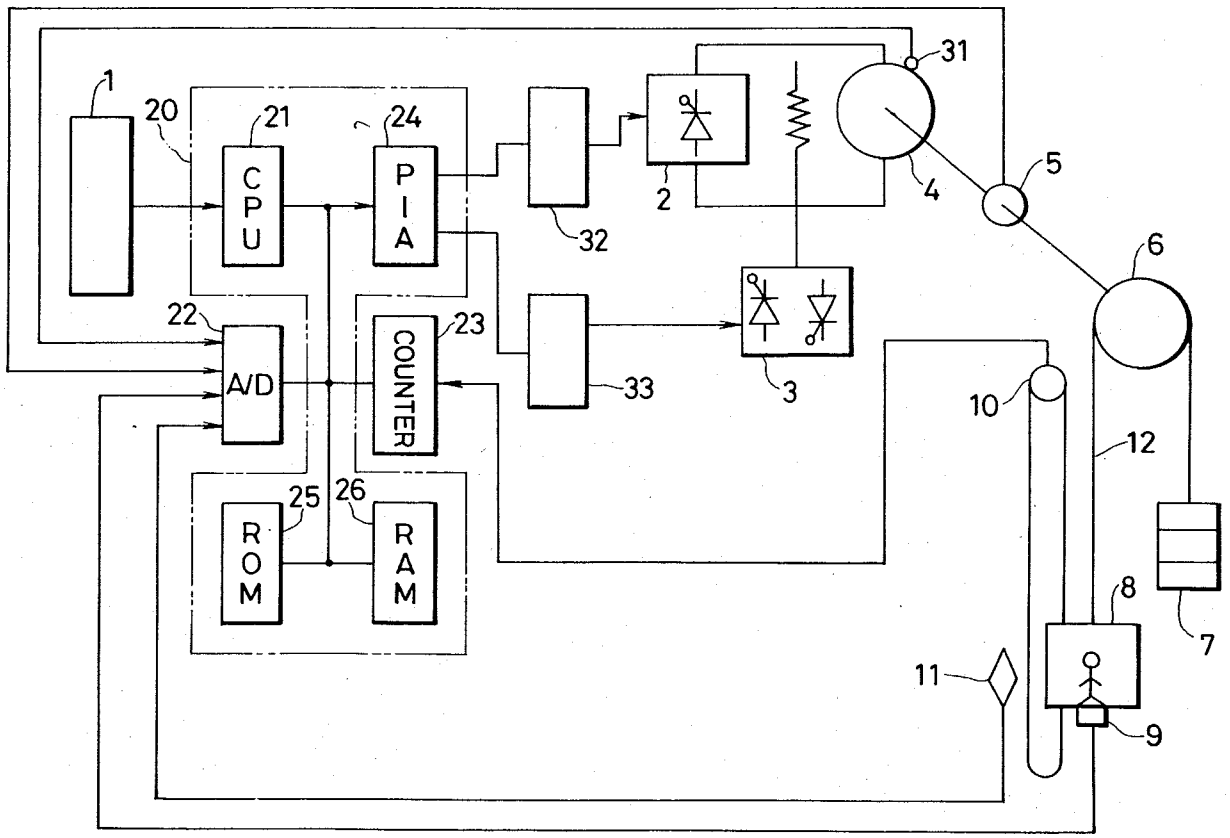

FIG. 1 is a general constructional diagram of one embodiment of a D.C. elevator control apparatus to which the present invention is applied.

Referring to the figure, an elevator cage 8 and a balance weight 7 are suspended by a sheave 6 through a rope 12 in well bucket fashion, and a D.C. motor 4 drives the cage 8 through the sheave 6. On the other hand, in the motor control portion 20 of the elevator, when a start command and information required for the operation, such as stopping floor information, are received by a CPU 21 from an elevator supervisory device 1, the ignition signals of power converters 2, 3 for controlling the cage driving D.C. motor 4 are prepared from data stored in a ROM 25 as well as a RAM 26 and information necessary for the control received from an A/D converter 22 as well as a counter 23, in accordance with software written in the ROM 25, and the delivered to gate devices 32, 33 through a PIA 24. Here, the "information necessary for the control" signifies the information of a load in the cage derived from a load sensor 9, the information of the temperature of the motor derived from a temperature sensor 31, the information of the velocity of the cage derived from a velocity sensor 5, and the information of the position of the cage derived from a pulse generator 10 and a microoperation position sensor 11.

Figure 2:
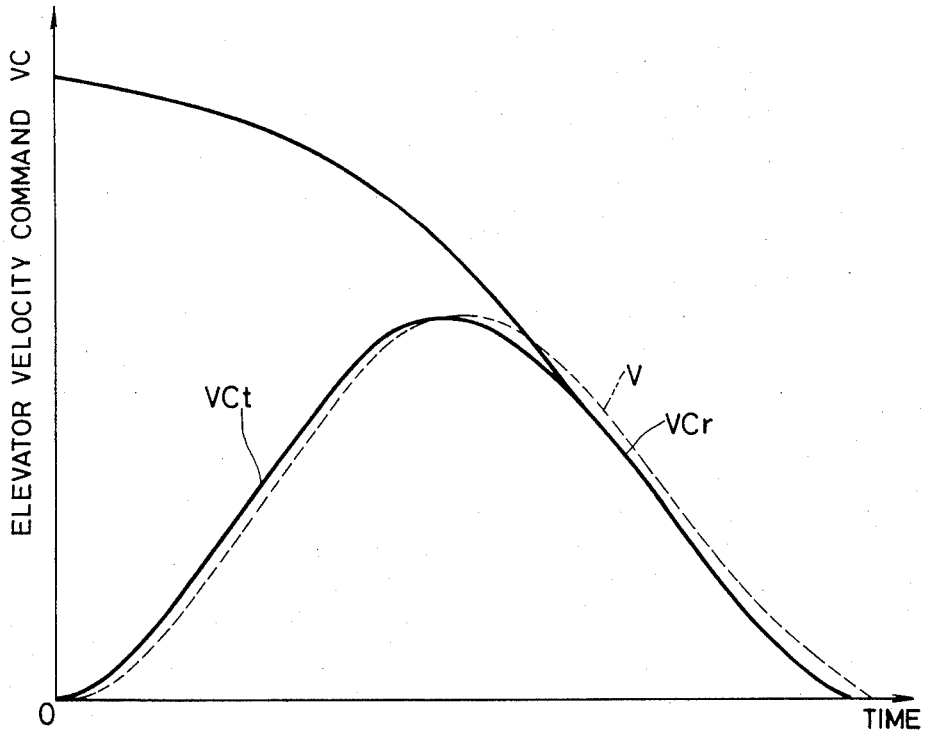

Next, the operating principles of the present embodiment will be described with reference to FIGS. 2 and 3. FIG. 2 is a graph showing the relationship of the velocity to the command of the elevator. As shown in the figure, in the elevator, during acceleration, a time-based velocity command $VC_t$ with a good ride taken into consideration is generated, while during deceleration, a distance-based velocity command $VC_r$ dependent upon a distance to a scheduled stopping position is generated in order to accurately stop the cage at the scheduled stopping position. The motor 4 is controlled in accordance with the commands, and a case is considered where the actual velocity V thereof has become a characteristic indicated by a dotted line.

Figure 3:
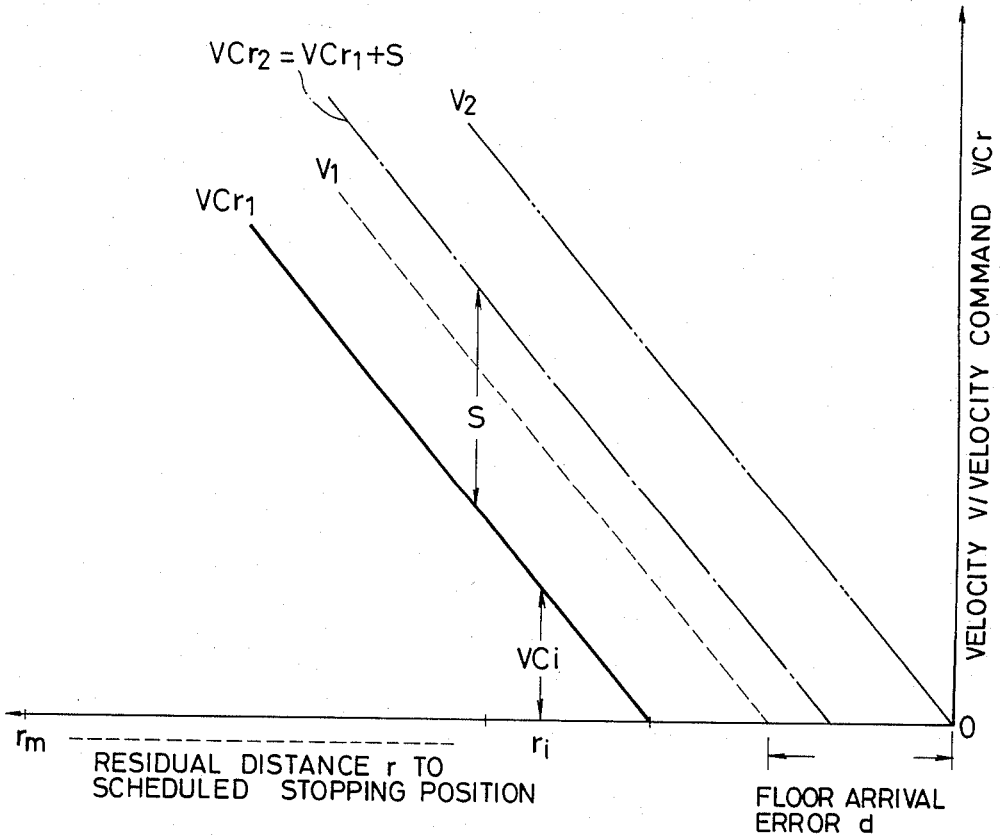

The relationship on this occasion between the velocity V and the distance-based velocity command $VC_r$ immediately before the stoppage is illustrated in FIG. 3. Here in the figure, in order to facilitate understanding of the floor arrival error (although this floor arrival error is indicated as an example of the floor arrival control error in the present embodiment, the floor arrival control error in the present invention is not restricted thereto but shall also include the elements of the velocity and the time to be explained later), the distance r is indicated on the axis of abscissas, and the actual velocity in the case of controlling the motor with a preset distance-based velocity command $VC_{r1}$ (hereinbelow, termed "reference distance-based velocity command") is denoted by $V_1$. More specifically, the actual velocity $V_1$ follows up the command $VC_{r1}$ with a predetermined delay, and the distance on this occasion between the stopping position of the cage and the scheduled stopping floor position 0 becomes the floor arrival position d.

In the conventional D.C. elevator, the cage has been operated to the floor position 0 at the small velocity in order to eliminate the floor arrival error d.

In contrast, in the present embodiment, the floor arrival error d is detected so as to correct a velocity command in the next operation. That is, the floor arrival error d is calculated in terms of the velocity into a correction magnitude S, with which the reference distance-based velocity command $VC_{r1}$ is corrected, whereby the distance-based velocity command $VC_{r2}$ is prepared. Thus, the corrected distance-based velocity command $VC_{r2}$ is used for the control in the next operation, thereby to realize the operation indicated by a velocity $V_2$ and to ameliorate the floor arrival precision.

The floor arrival error d fluctuates depending upon operating conditions on each occasion. More specifically, a load torque viewed from the motor, the elongation percentage of the rope, the set position of the position sensor of each floor, etc. change depending upon the load, running direction and scheduled stopping floor of the cage, etc., and the control characteristics of the motor change depending upon the temperature thereof, so that they form factors to fluctuate the floor arrival error d. In the present embodiment, therefore, the components of the floor arrival error d are collected for the respective floor arrival error fluctuating factors, the fluctuating factors greatly influential upon the floor arrival error d are analyzed by statistic processing, and the components of the correction magnitude S for the respective fluctuating factors of great influence are calculated. Thus, in the operation of the elevator, the reference distance-based velocity command $VC_{r1}$ is corrected by the use of the correction magnitude S corresponding to the fluctuating factors at that time, whereby the floor arrival error d is not affected even when these fluctuating factors have changed.

There will now be described the software construction of the motor control portion 20 for realizing the operation.

FIG. 4 shows memory maps for storing data etc. to be used in the present embodiment. Shown in (A) of the figure is a table for generating the reference distance-based velocity command $VC_{r1}$, in which are stored reference distance-based velocity commands corresponding to residual distances $r_i$ (i=0, . . . , n; i being an integer) to the scheduled stopping position as shown in FIG. 3. (B) of FIG. 4 shows a floor height table, which indicates the values of respective floors in the case where pulses produced by the pulse generator are counted while being added or subtracted in accordance with the moving direction (ascent or descent) of the cage, and which is described in detail in the specification of U.S. Pat. No. 4,367,811 mentioned before. (C) of the figure shows the memory map of variables for use in the present embodiment.

Figure 5:
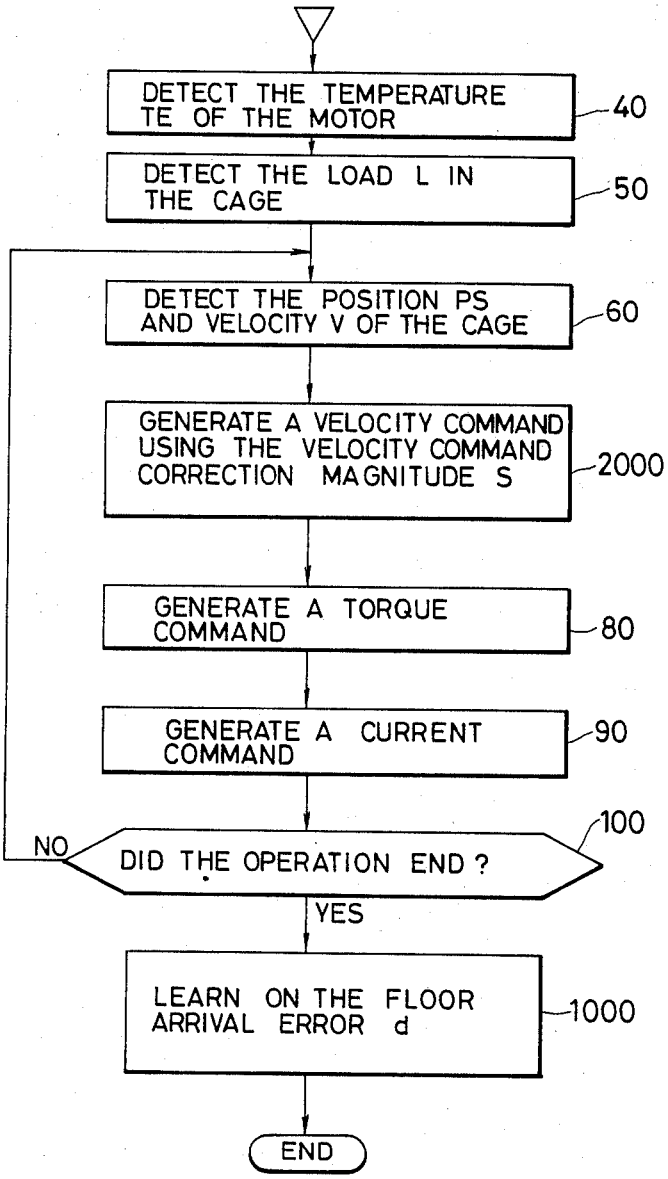

FIG. 5 is a basic flow chart for explaining the outline of the processing of the elevator motor control portion 20. Upon receiving the start command from the elevator supervisory device 1, the controlling CPU detects the temperature of the motor 4 and the load in the cage 8 as indicated by numerals 40 and 50 in the figure and starts the elevator. During the operation of the elevator, processing steps 60 to 100 are successively performed every sampling period. More specifically, as indicated by numeral 60 in the figure, the position of the cage 8 is detected in such a way that the pulses of the pulse generator 10 are counted in consideration of the moving direction of the cage 8, and the velocity of the cage 8 is detected in such a way that the output of the velocity sensor 5 is A/D-converted (25). In addition, as indicated by numeral 2000 in the figure, a velocity command is generated using the velocity command correction magnitude S. As indicated by numeral 80 in the figure, a torque command is generated by comparing the detected velocity of the cage and the generated velocity command. As indicated by numeral 90 in the figure, this torque command is converted into a current command, namely, the ignition signal of the power converter which controls the motor for driving the cage, and the ignition signal is applied to the gate device of the power converter. Such processing is cyclically performed every sampling period till the end of the elevator operation. After the end of the operation, as indicated by numeral 1000 in the figure, the floor arrival error is detected to execute learning on this floor arrival error and to evaluate the velocity command correction magnitude for use in and after the next operation.

Figure 6:
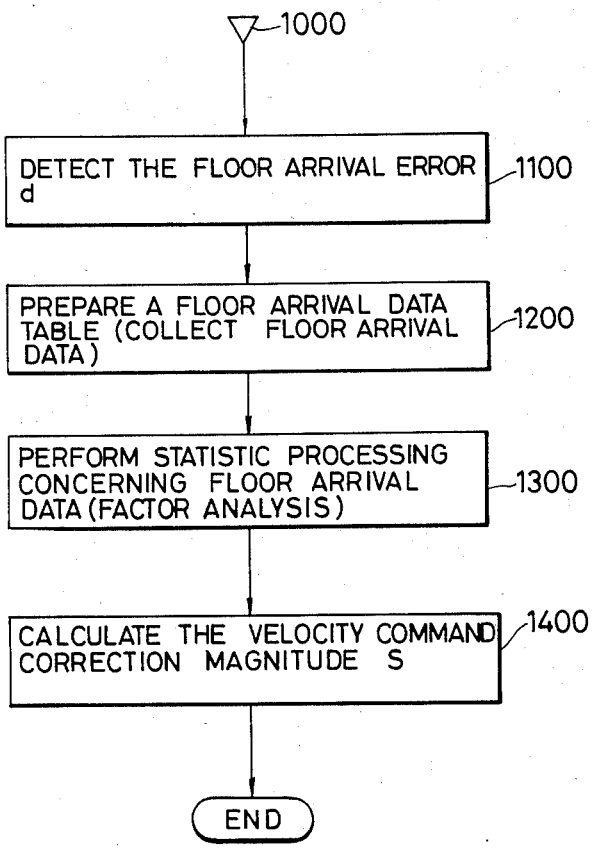

Next, the learning on the floor arrival error indicated by Step 1000 will be described in detail. FIG. 6 shows a flow chart of the outline of the processing in the learning on the floor arrival error. Here, the floor arrival error is first detected as indicated by numeral 1100 in the figure, and a floor arrival data table indicative of the relationship between the floor arrival control error fluctuating factors and the floor arrival error is subsequently prepared as indicated by numeral 1200 in the figure. Further, as indicated by numeral 1300 in the figure, statistic processing concerning floor arrival data (factor analysis) is performed using the floor arrival data table in order to clarify the causal relations between the floor arrival control error fluctuating factors and the floor arrival error. That is, to what extent each of several floor arrival control error fluctuating factors to be mentioned later concerns the floor arrival error is analyzed, to determine the factors which are to be stored in the table as the parameters of the velocity command correction magnitude S. Thereafter, as indicated by numeral 1400 in the figure, the velocity command correction magnitude S is calculated from the detected floor arrival error, and the velocity command correction magnitude S is stored in the table with the parameters being the factors relevant to the floor arrival error determined by the factor analysis. In this regard, however, the factor analysis cannot be carried out unless the data items of the floor arrival data table are gathered to some extent. For this reason, the calculated values of the velocity command correction magnitude S are stored in a table in which parameters are all the floor arrival control error fluctuating factors considered, at a stage preceding the factor analysis, whereupon the table of the velocity command correction magnitude with the parameters being all the floor arrival error fluctuating factors is converted into the table with the parameters being only the factors found to concern the floor arrival error as the result of the factor analysis, when the factor analysis has been finished.

Figure 7:
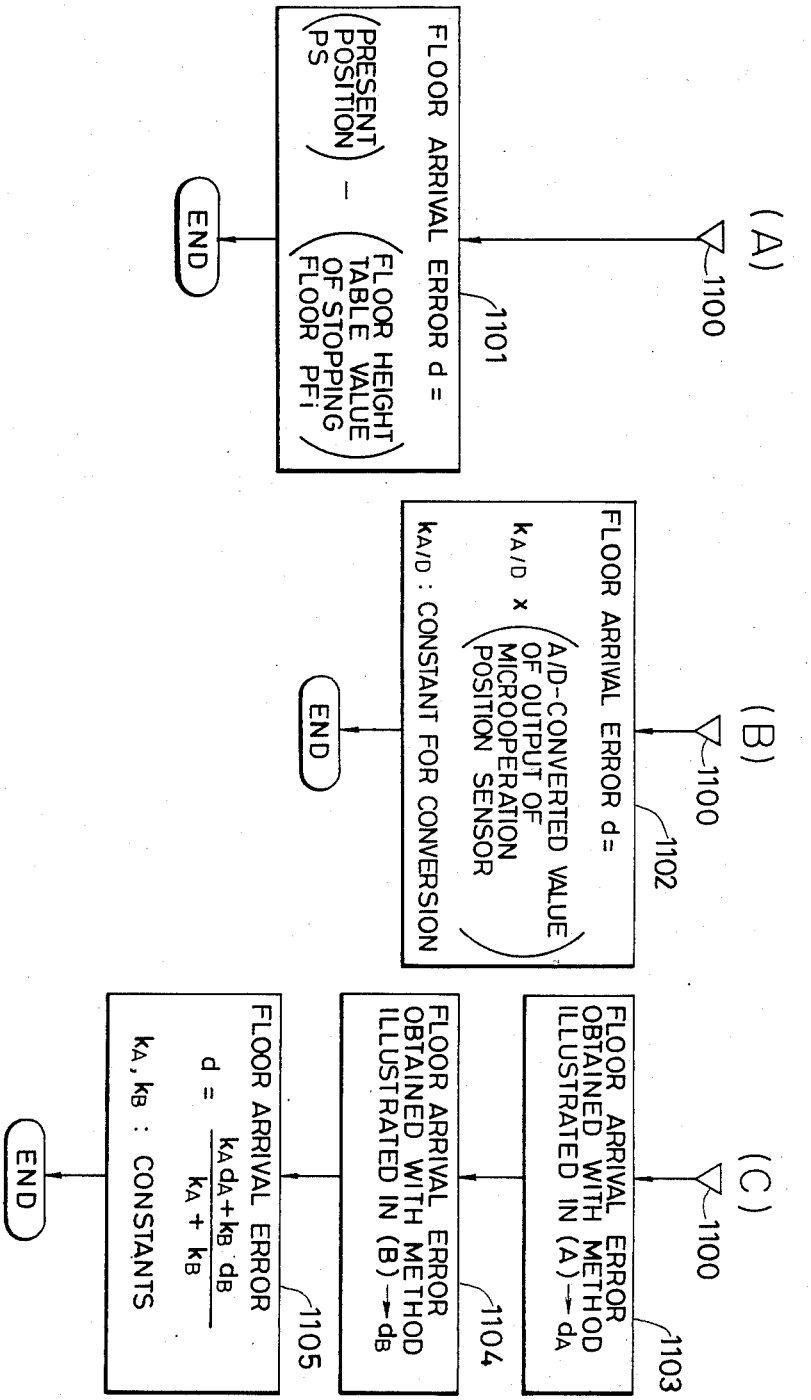

Next, the contents of the respective blocks 1100 to 1400 indicated in the figure will be described in detail. First, the details of the detection of the floor arrival error indicated in the block 1100 are shown in FIG. 7. Shown in (A) of the figure is a method in which, as indicated by numeral 1101, the floor arrival error d is evaluated from the present position PS of the cage obtained by counting the pulses produced by the pulse generator and the floor height table value $PF_i$. This method has the merit that the position sensor for the microoperation is dispensed with. Subsequently, shown in (B) of the figure is a method in which the floor arrival error d is evaluated by subjecting the output of the microoperation position sensor to A/D conversion as indicated by numeral 1102. Symbol $k_{A/D}$ denotes a constant for obtaining the floor arrival error d through the A/D conversion. Further, shown in (C) is a method in which the floor arrival errors obtained by both the methods illustrated in (A) and (B) are respectively denoted by $d_A$ and $d_B$ as indicated by numerals 1103 and 1104, and the floor arrival error d is evaluated from these two results. In a case where constants $k_A$ and $k_B$ indicated in Step 1105 in the figure meet $k_A=k_B$, the average of $d_A$ and $d_B$ becomes the floor arrival error d, and in a case where they meet $k_A<k_B$, the floor arrival error d is evaluated by greater weighting of the the result $d_B$ obtained with the method of (B) than that obtained with the method of (A).

Figure 8:
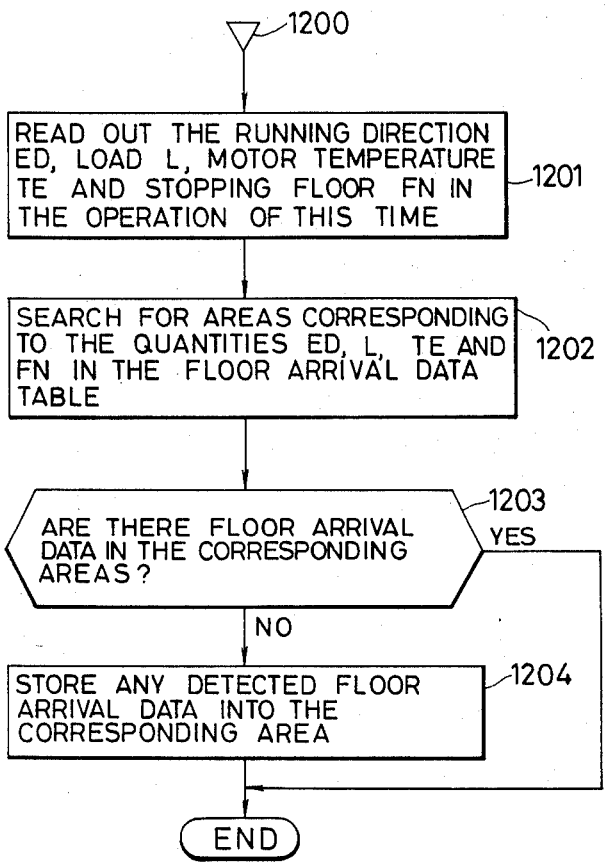
Figure 9:
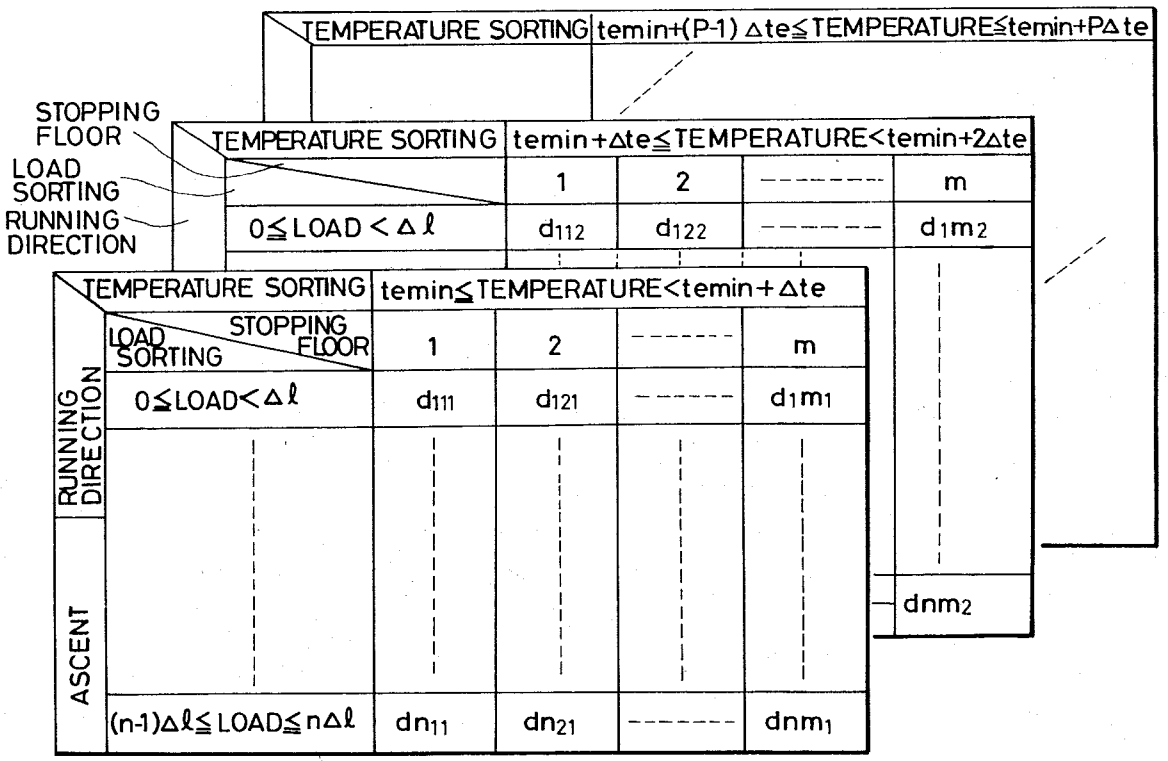

Now, the preparation of the floor arrival data table indicated in Block 1200 in FIG. 6 is detailed in FIG. 8. In preparing the floor arrival data table, all the floor arrival control error fluctuating factors in the operation of this time having been detected beforehand are first read out as indicated by numeral 1201 in the figure. In the present embodiment, the floor arrival control error fluctuating factors are the running direction ED, load L, motor temperature TE and stopping floor FN. Next, as indicated by numeral 1202, areas which correspond to the conditions of the floor arrival control error fluctuating factors in the operation of this time are searched for in the floor arrival data table. That is, areas which contain floor arrival data corresponding to the running direction ED, load L, motor temperature TE and stopping floor FN in the operation of this time are searched for in the floor arrival data table shown in FIG. 9. As indicated by numeral 1203, if the floor arrival data items have already been stored in the corresponding areas is checked. If any are not stored, a floor arrival error detected this time is stored into the corresponding area as the floor arrival data as indicated by numeral 1204. When such processing is performed, the floor arrival data table becomes a table which indicates the relations of the floor arrival control error fluctuating factors with the floor arrival error in the case where the velocity command correction magnitude S is null, namely, the case where the elevator is controlled by the reference distance-based velocity command (controlled by the identical velocity command). Although only the floor arrival data table for the ascent operation is shown in FIG. 9, a similar floor arrival data table is also prepared for the descent operation.

Figure 10:
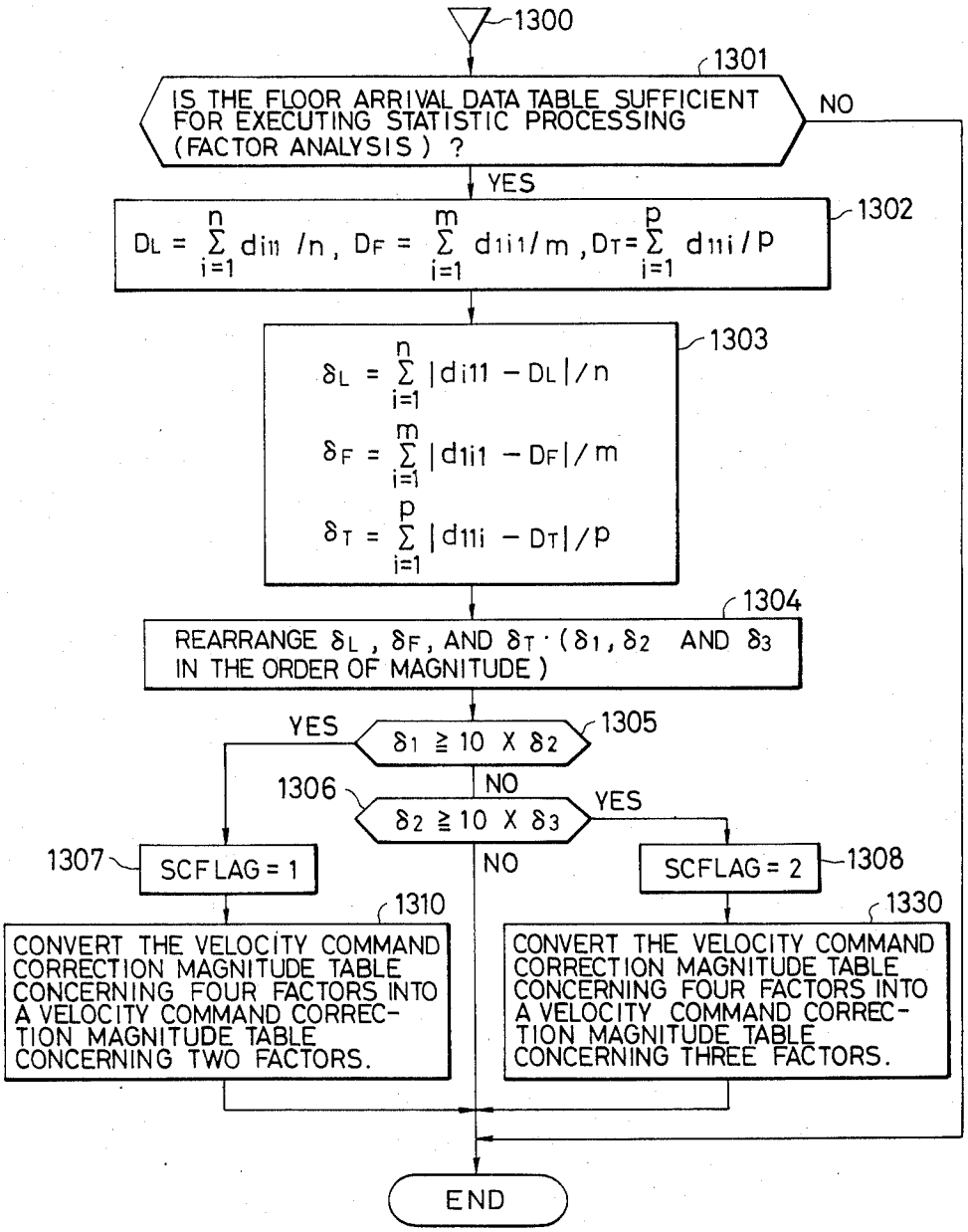
Figure 11:
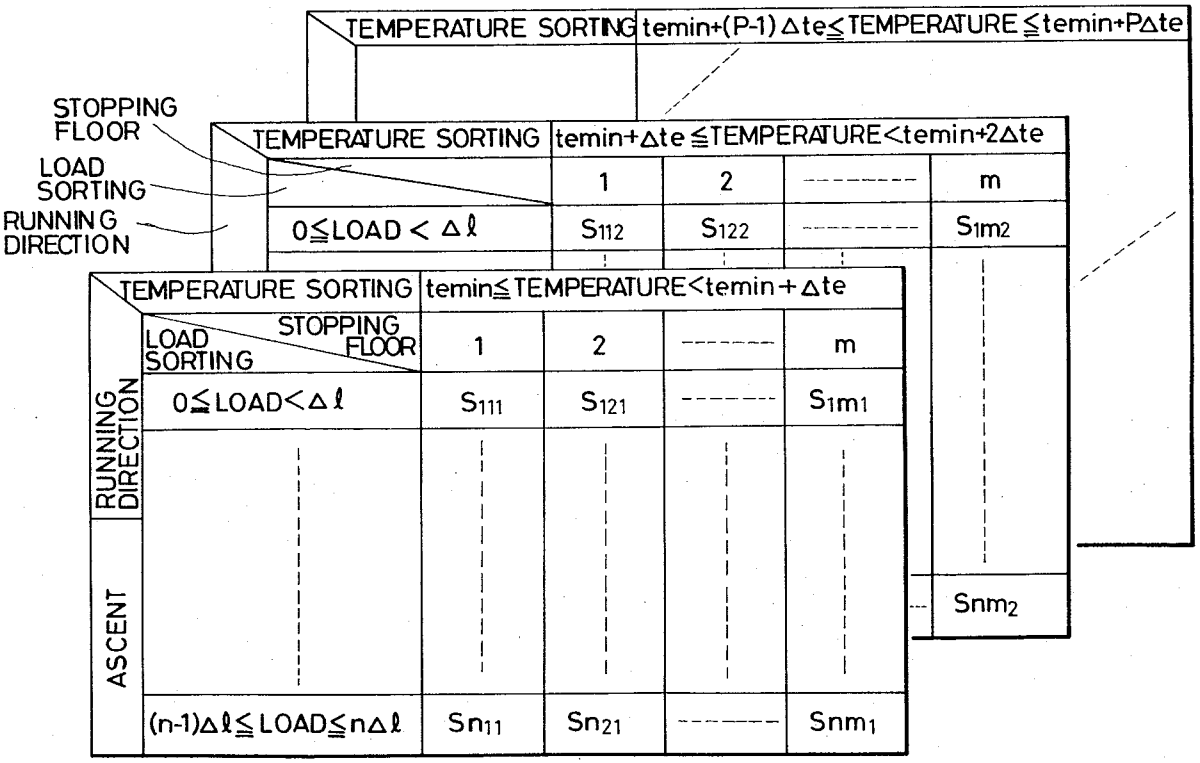

Next, the details of the statistic processing on the floor arrival data (factor analysis) indicated in Step 1300 in FIG. 6 are exemplified in FIG. 10. The figure illustrates a case where, among the floor arrival control error fluctuating factors, the three of the load L, stopping floor FN and motor temperature TE are subjected to the factor analysis. Here, as indicated by numeral 1301, the quantity of data of the floor arrival data table is first checked to judge if the factor analysis is possible. When the factor analysis is possible, processing steps 1302 et seq. are executed. Hereinbelow, these processing steps will be described in detail. Now, when note is taken of the load L by way of example, the average value of floor arrival data is expressed by $D_L$ in Block 1302 in the figure in a case where the stopping floor FN and the motor temperature TE remain constant (FN =1st floor, $te_{min} \leqq TE < te_{min} + \Delta te$) and where only the load L has changed. Subsequently, the average $\delta_L$ of the absolute values of the differences between this average value $D_L$ and respective floor arrival data is obtained as indicated by Block 1303 in the figure. Then, this average $\delta_L$ becomes a numerical value indicative of the dispersion of the floor arrival data (namely, floor arrival errors) in the case where only the load L has changed, and it can be said that the floor arrival error is more affected as the numerical value is greater. Likewise, regarding the stopping floor FN and the motor temperature TE, $\delta_F$ and $\delta_T$ are evaluated as indicated in Blocks 1302 and 1303. Subsequently, in order to compare and analyze the magnitudes of these numerical values $\delta_L$, $\delta_F$ and $\delta_T$, the averages $\delta_L$, $\delta_F$ and $\delta_T$ are rearranged as indicated by numeral 1304, to set the greatest one of them as $\delta_1$, the second greatest one as $\delta_2$ and the smallest one as $\delta_3$. As indicated by numeral 1305, the magnitudes of $\delta_1$ and $\delta_2$ are compared. In a case where $\delta_1$ is sufficiently greater than $\delta_2$ (in the illustration, 10 times or more greater), the floor arrival error is judged to be almost governed by the factor denoted by $\delta_1$ and the running direction ED excluded from the factor analysis of this time. Then, as indicated by numeral 1307, a flag indicative of the judgement (SCFLAG) is set, whereupon as indicated by numeral 1310, the table of the velocity command correction magnitude S prepared before, with the parameters being the running direction ED, load L, stopping floor FN and motor temperature TE as shown in FIG. 11, is converted into a table whose parameters are the running direction ED and the factor denoted by $\delta_1$ (in the illustration, the load L) as shown in FIG. 12. In addition, as indicated by Step 1306 in FIG. 10, the magnitudes of $\delta_2$ and $\delta_3$ are compared. In a case where $\delta_3$ is sufficiently smaller than $\delta_2$ (in the illustration, below 1/10), it is judged that the factor denoted by $\delta_3$ hardly affects the floor arrival error. As indicated at numeral 1308, a flag indicative of this is set. As indicated at numeral 1330, the table of the velocity command correction magnitude S prepared before in which the parameters are the running direction ED, load L, stopping floor FN and motor temperature TE as shown in FIG. 11 is converted into a table the three factors except the factor denoted by $\delta_3$ (in the illustration, the motor temperature TE) are used as parameters as shown in FIG. 13.

Figure 14:
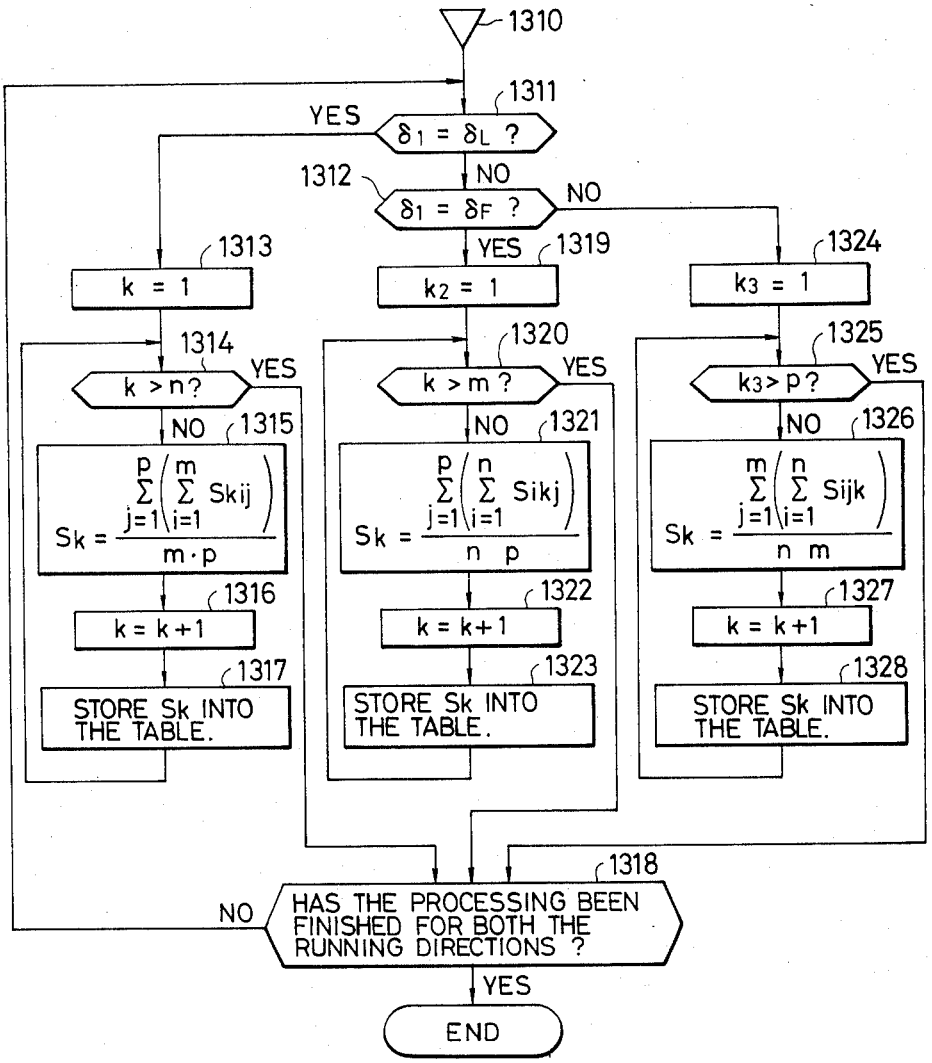

Next, the conversion of these tables will be described in detail. FIG. 14 illustrates the details of the conversion indicated at Step 1310, into the table whose parameters are the running direction ED and the factor denoted by $\delta_1$. Here as indicated at numerals 1311 and 1312, $\delta_1$ and $\delta_L$ and also $\delta_1$ and $\delta_F$ are compared, thereby to judge if the factor denoted by $\delta_1$ is the load L, stopping floor FN or motor temperature TE. In the figure, the processing of 1313 et seq. illustrates a case where the factor denoted by $\delta_1$ is the load L, the processing of 1319 et seq. a case where it is the stopping floor FN, and the processing of 1324 et seq. a case where it is the motor temperature TE. Now, the case where the factor denoted by $\delta_1$ is the load L will be taken as an example, and the processing of 1313 et seq. will be explained. Here, the processing of calculating the average $S_k$ of all velocity command correction magnitudes (numbering m×p where m denotes the number of stopping floors, and p denotes the number of sections of the motor temperature) for an identical load section (1315 in the figure) and storing it into the table (1317 in the figure) is performed for all the load sections (1313, 1314 and 1316 in the figure) and in both the running directions (1318 in the figure). In addition, the processing of 1319 et seq. is performed for an identical stopping floor, and the processing of 1324 et seq. is performed for an identical motor temperature section, similarly to the processing of 1313 et seq. for the load.

Figure 15:
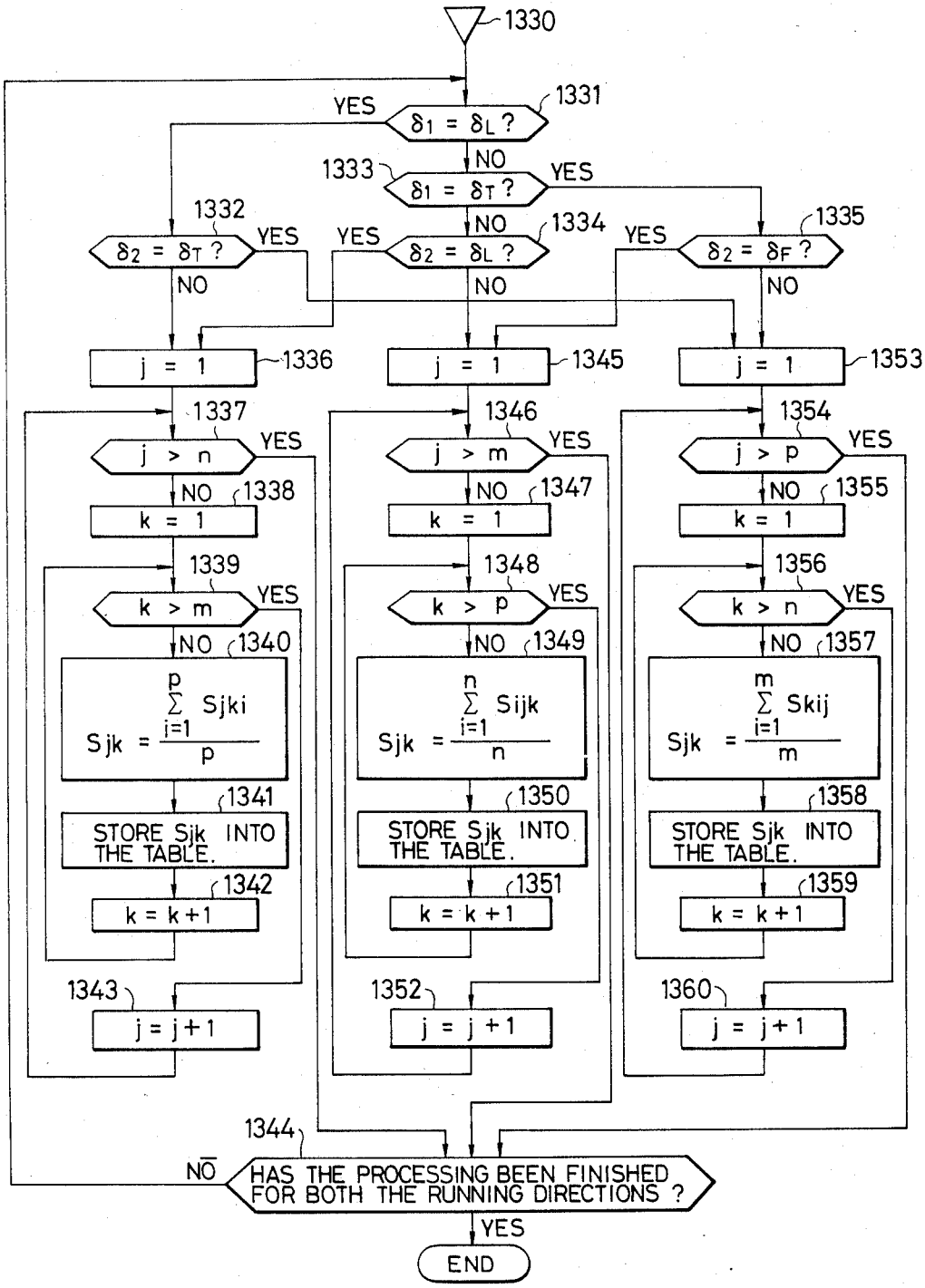

Next, FIG. 15 illustrates the details of the conversion indicated at numeral 1330 in FIG. 10, into the table whose parameters are the three factors other than the factor denoted by $\delta_3$. Here, as indicated by numerals 1331 to 1335, $\delta_1$ and $\delta_2$ are compared with $\delta_L$, $\delta_F$ and $\delta_T$, thereby to judge if the factors denoted by $\delta_1$ and $\delta_2$ are the load L, stopping floor FN or motor temperature TE. In the figure, the processing of 1336 et seq. illustrates a case where the factors denoted by $\delta_1$ and $\delta_2$ are the load L and the stopping floor FN, the processing of 1345 et seq. a case where they are the stopping floor FN and the motor temperature TE, and the processing of 1353 et seq. a case where they are the motor temperature and the load L. Hereinbelow, the processing of 1336 et seq. will be described as an example. Here, the processing of calculating the average $S_{jk}$ of all the velocity command amendment magnitudes (numbering p which denotes the number of sections of the motor temperature) for an identical load section and stopping floor (1340 in the figure) and storing it into the table (1341 in the figure) is performed for all the stopping floors (1338, 1339 and 1342 in the figure) and all the load sections (1336, 1337 and 1343 in the figure) and in both the running directions (1344 in the figure). In addition, the processing of 1345 et seq. is performed for an identical stopping floor and motor temperature section, and the processing of 1353 et seq. is performed for an identical motor temperature section and load section, similarly to the processing indicated at 1336 et seq.

Figure 16:
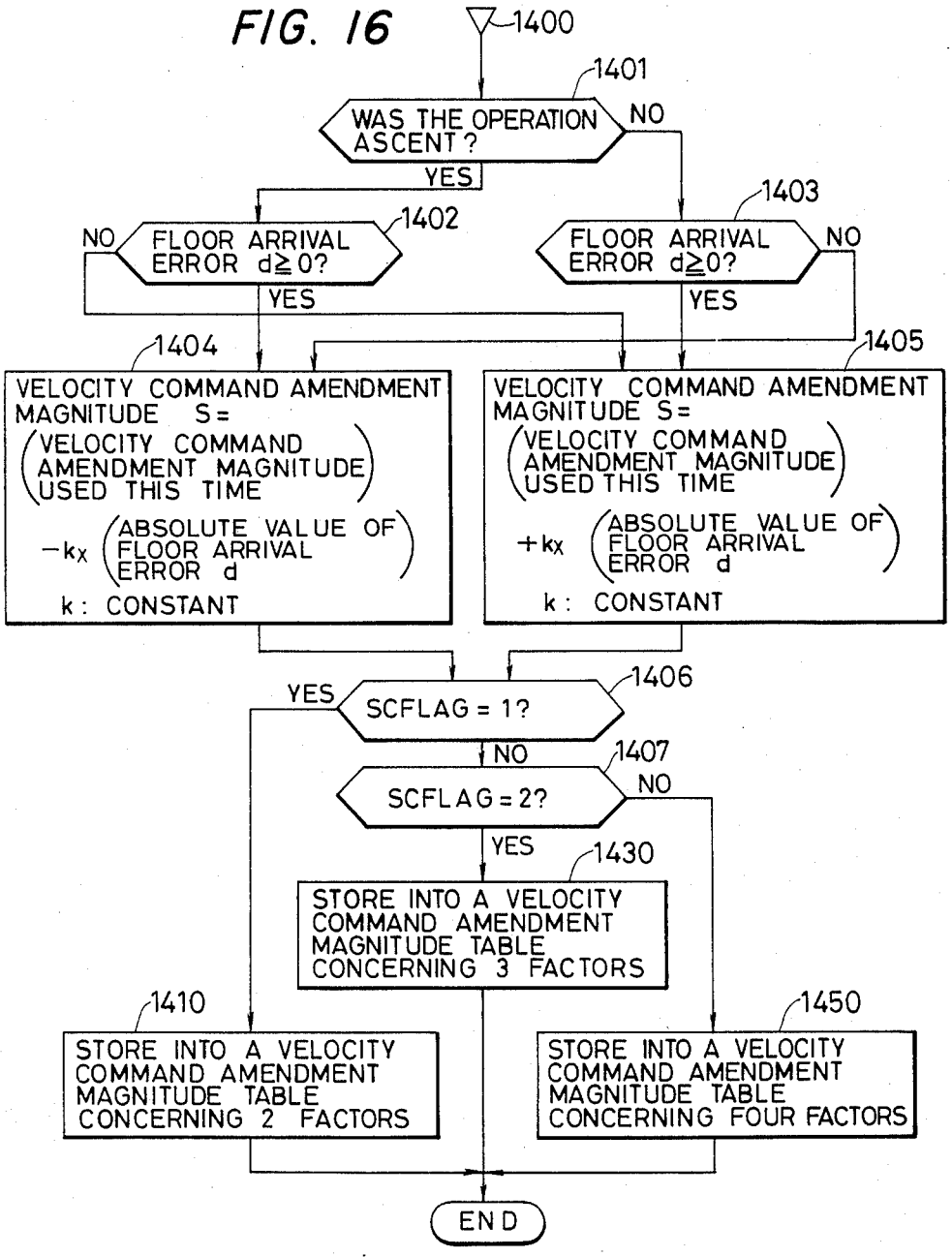

Next, the details of the calculation of the velocity command amendment magnitude S shown at 1400 in FIG. 6 are shown in FIG. 16. As shown in (A) of FIG. 7, the floor arrival error d has a plus value when the cage deviates on the upper side relative to the position of the stopping floor, and it has a minus value when the cage deviates on the lower side. As indicated by numerals 1401, 1402 and 1403 in FIG. 16, therefore, whether or not the cage has stopped beyond a scheduled stopping position is judged from the running direction and the sign of the floor arrival error. When it has been judged that the cage has stopped beyond the scheduled stopping position, the velocity command amendment magnitude S is amended in proportion to the magnitude of the floor arrival error d from the velocity command amendment magnitude used in the operation of this time as indicated at numeral 1404 in the figure, in order to control the cage so as to stop on this side more in the next operation than in the operation of this time as to the same floor arrival control error fluctuating factor. Here, k in Step 1404 is a constant for reflecting the distance (floor arrival error) upon the velocity (velocity command). On the other hand, when the cage has stopped on this side of the scheduled stopping position, processing indicated at numeral 1405 in the figure is performed on the basis of a similar idea. Flags SCFLAG indicative of factor analysis results are referred to as indicated by numerals 1406 and 1407, whereupon velocity command amendment magnitudes S obtained are stored as indicated by numerals 1410 (the number of factors=2), 1430 (the number of factors=3) and 1450 (the number of factors=4) in accordance with the number of the parameters of the velocity command amendment magnitude S, that is, with the number of those factors among the initially set floor arrival control error fluctuating factors (running direction ED, load L, stopping floor FN and motor temperature TE) which have been found influential upon the floor arrival error as the result of the factor analysis. At the stage before the factor analysis is performed, that is, at the stage at which the floor arrival data items of the floor arrival data table are insufficient for performing the factor analysis, and in a case where it has been judged as the result of the factor analysis that all the initially set floor arrival control error fluctuating factors (here, four factors) are influential upon the floor arrival error, the table of the velocity command amendment magnitude S in which all the factors are used as the parameters is naturally prepared as indicated by Step 1450.

Figure 17:
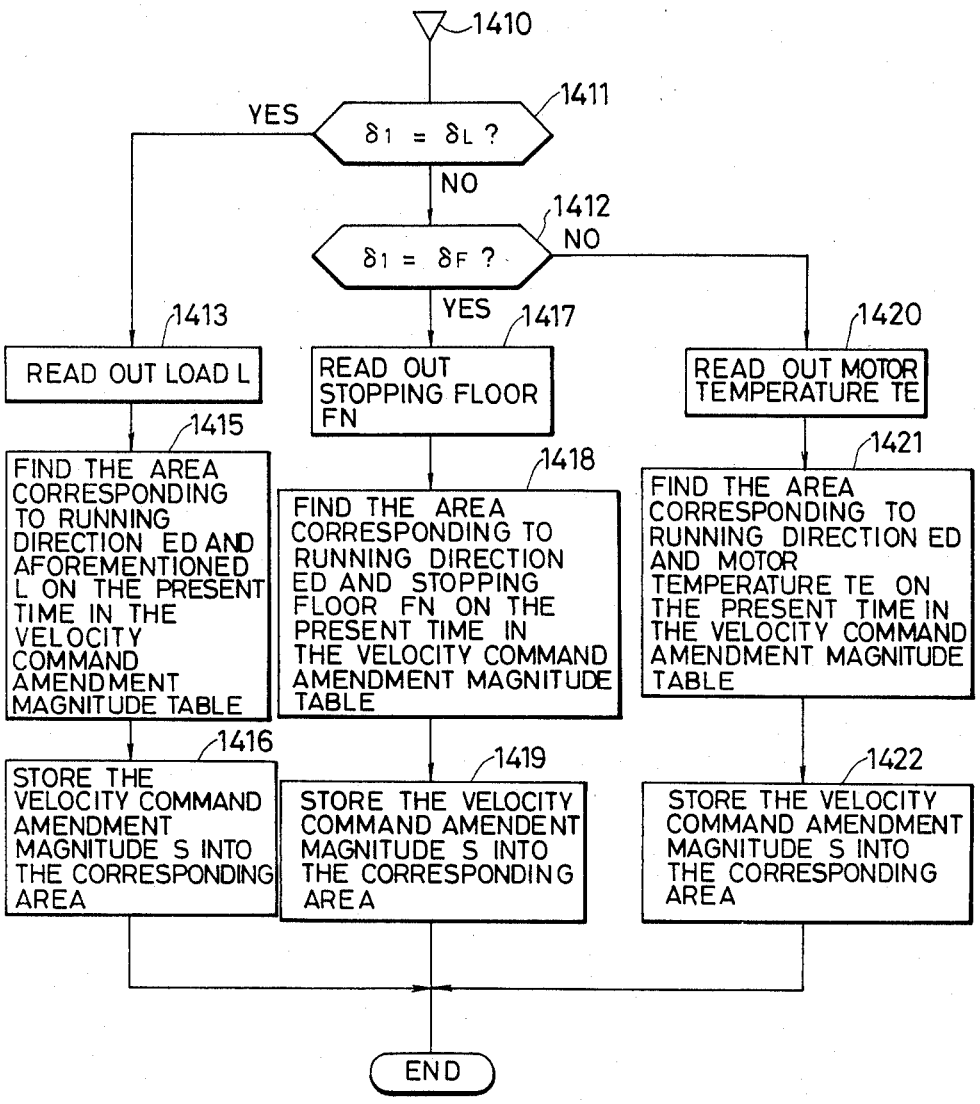
Figure 18:
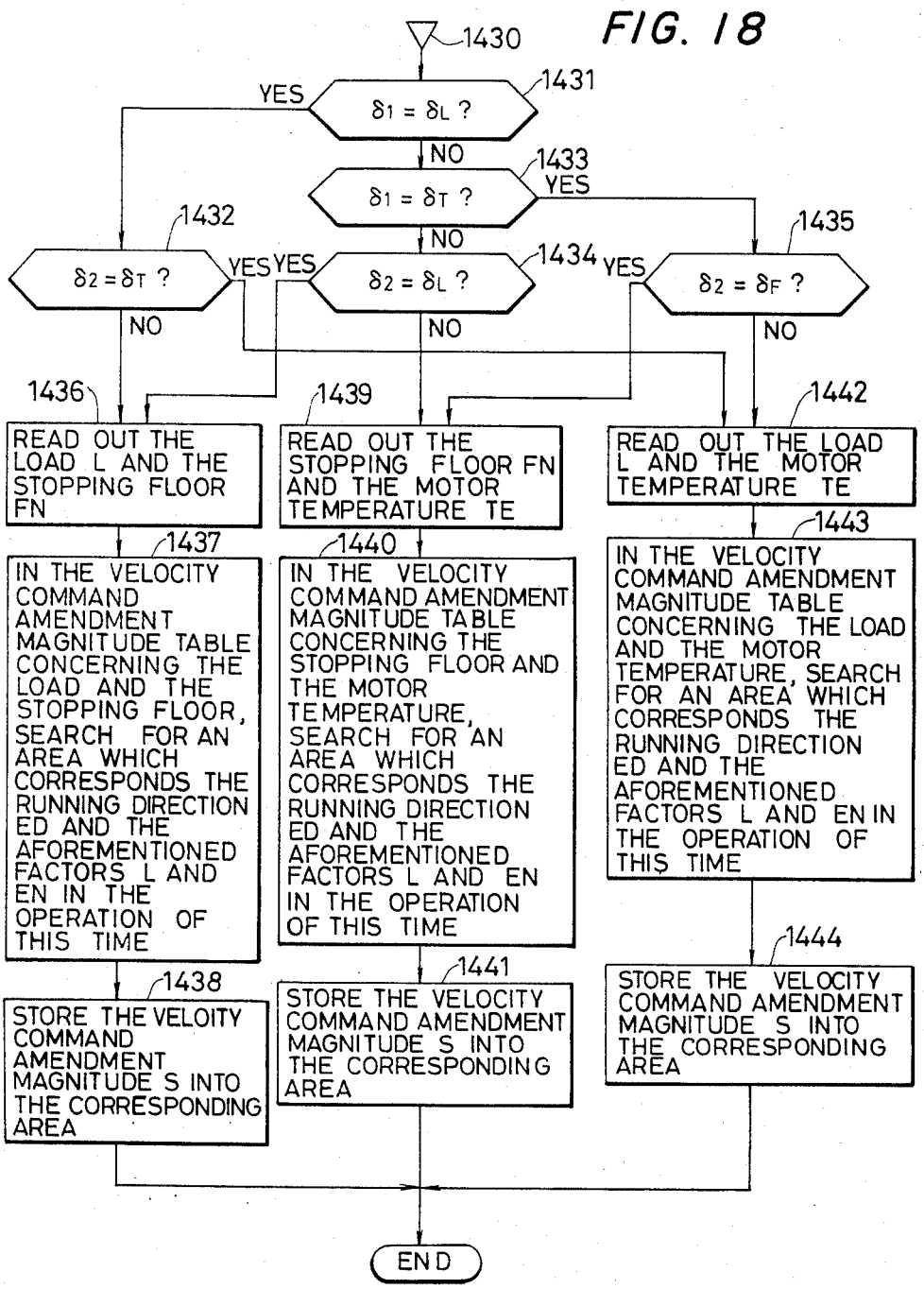

Next, the storage into the table of the velocity command amendment magnitude S shown at numeral 1410, 1430 or 1450 in the figure will be described in detail. First, the details of the storage into the velocity command amendment magnitude table concerning 2 factors illustrated at 1410 in the figure are shown in FIG. 17. Here, likewise to Steps 1311 and 1312 in FIG. 13, the floor arrival control error fluctuating factors to be used as the parameters of the table of the velocity command amendment magnitude S are judged by comparing $\delta_1$ with $\delta_L$ and $\delta_F$ as indicated at numerals 1411 and 1412. The processing indicated by Steps 1413 et seq. corresponds to a case where the parameters are the running direction ED and load L, the processing indicated by Steps 1417 et seq. a case where they are the running direction ED and stopping floor FN, and the processing indicated by Steps 1420 et seq. a case where they are the running direction ED and motor temperature TE. The processing of 1413 et seq. will be explained as an example. The load L in the operation of this time is read out (Step 1413 in the figure), that area of the table of the velocity command amendment magnitude S which corresponds to the running direction ED and load L at this time is searched for (Step 1415 in the figure), and the velocity command amendment magnitude S calculated by Step 1404 or 1405 in FIG. 16 is stored into this area (Step 1416 in the figure). The processing of 1417 et seq. and the processing of 1420 et seq. are similar to the above. Secondly, the details of the storage into the velocity command amendment magnitude table concerning 3 factors illustrated at 1430 in FIG. 16 are shown in FIG. 18. Here, likewise to Steps 1331, 1332, 1334 and 1335 in FIG. 15, $\delta_1$ and $\delta_2$ are compared with $\delta_L$, $\delta_F$ and $\delta_T$ as indicated at numerals 1431, 1432, 1433, 1434 and 1435, to judge the floor arrival control error fluctuating factors which ought to be used as the parameters of the table of the velocity command amendment magnitude S. The processing of 1436 et seq. indicates a case where the parameters are the running direction ED, load L and stopping floor FN; the processing of 1439 et seq. a case where they are the running direction ED, stopping floor FN and motor temperature TE; and the processing of 1442 et seq. a case where they are the running direction ED, load L and motor temperature TE. In any of the cases, there is performed the processing of reading out the parameters, searching for the corresponding area, and storing into the area the velocity command amendment magnitude S calculated by Step 1404 or 1405 in FIG. 16, likewise to Steps 1413, 1415 and 1416 in FIG. 17. The storage into the velocity command amendment magnitude table concerning 4 factors as indicated by numeral 1450 in FIG. 16 corresponds to the case where all the floor arrival control error fluctuating factors initially set become the parameters of the velocity command amendment magnitude S. Here, there is performed the processing of searching for the area in the velocity command amendment magnitude table corresponding to all the floor arrival control error fluctuating factors (running direction ED, load L, stopping floor FN, and motor temperature TE) and storing the velocity command amendment magnitude S calculated at Step 1404 or 1405 in FIG. 16.

Figure 19:
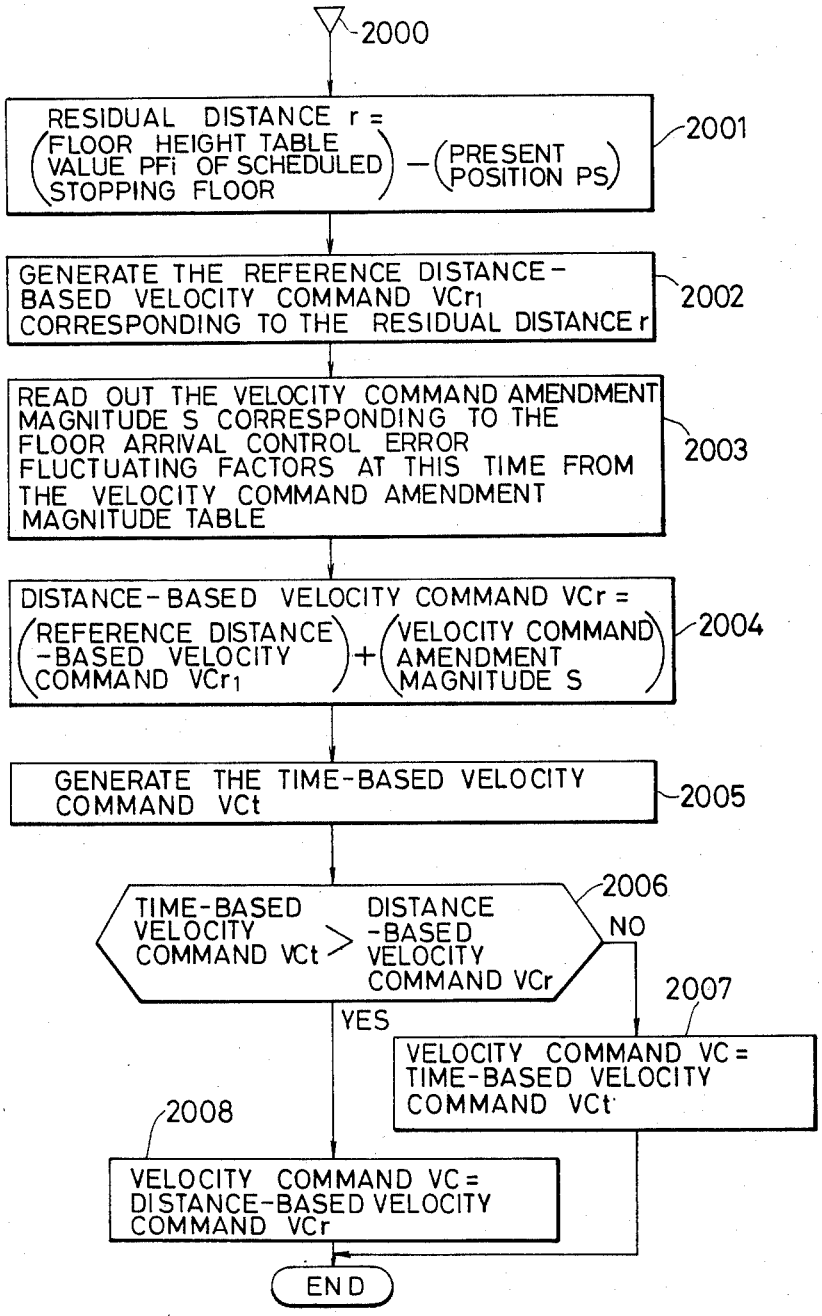

Lastly, the velocity command generation employing the velocity command amendment magnitude S indicated by numeral 2000 in FIG. 5 is illustrated in detail in FIG. 19. Here, as indicated by Step 2001, the residual distance r to the scheduled stopping position is evaluated from the present position PS obtained by counting pulses produced by the pulse generator and the floor height table value $PF_i$ of the scheduled stopping floor. As indicated by Step 2002, the reference distance-based velocity command $VC_{r1}$ corresponding to this residual distance r is generated on the basis of the table shown in (A) of FIG. 4. Subsequently, as indicated by Step 2003, the velocity command amendment magnitude S corresponding to the floor arrival control error fluctuating factors in the operation of this time is obtained from the velocity command amendment magnitude table. As indicated by Step 2004, this velocity command amendment magnitude S is added to the reference distance-based velocity command $VC_{r1}$ generated before, thereby to evaluate the distance-based velocity command $VC_r$. Owing to such processing, this distance-based velocity command $VC_r$ becomes a velocity command which conforms with the floor arrival control error fluctuating factors in the operation of this time. Next, as indicated by Step 2005, the time-based velocity command $VC_t$ is generated. The magnitudes of both the velocity commands $VC_t$ and $VC_r$ are compared as indicated by Step 2006, and the smaller command is used as the velocity command VC for controlling the elevator (at 2007 and 2008 in the figure). The time-based velocity command $VC_t$ is adopted during acceleration, while the distance-based velocity command $VC_r$ with the velocity command amendment magnitude S added to the reference distance-based velocity command $VC_{r1}$ is adopted during deceleration.

According to the present embodiment thus far described, a favorable floor arrival precision is attained in an elevator. In an elevator having hitherto performed the micro-operation, it can be abolished. The problem of a shift shock attendant upon the micro-operation, or the problem of power consumption can be improved.

OTHER EMBODIMENTS OF THE PRESENT INVENTION

Figure 20:
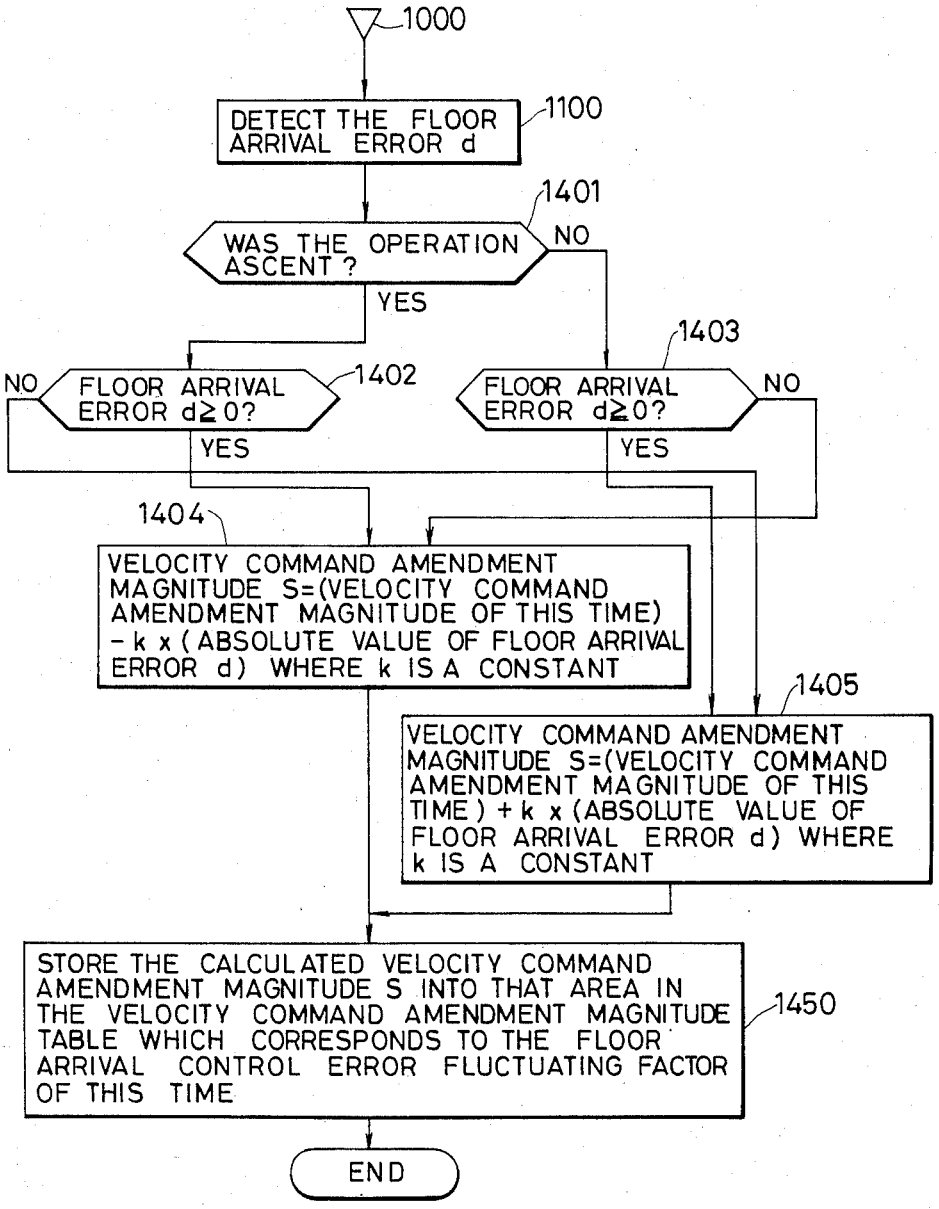

Another embodiment of the present invention is shown in FIG. 20. The present embodiment is one embodiment in the case where the factor analysis is not performed in the preceding embodiment. Accordingly, the floor arrival data table having been prepared for performing the factor analysis is not prepared. Here, the floor arrival error d is detected as indicated by numeral 1100 in the figure; whether or not the cage has stopped beyond the scheduled stopping position is judged as indicated by numerals 1401, 1402 and 1403; the velocity command amendment magnitude S is calculated as indicated by numerals 1404 and 1405; and this velocity command amendment magnitude S is stored into the area of the velocity command amendment magnitude table corresponding to the floor arrival control error fluctuating factors as indicated by numeral 1450.

Thus, the present embodiment has the merit that, since the factor analysis is not performed, the software becomes simpler than in the preceding embodiment. Since, however, the factor analysis is not executed, factors hardly contributing to the floor arrival error are also learned in some cases. The embodiment is effective in a case where the fluctuating factors are known in advance.

Figure 21:
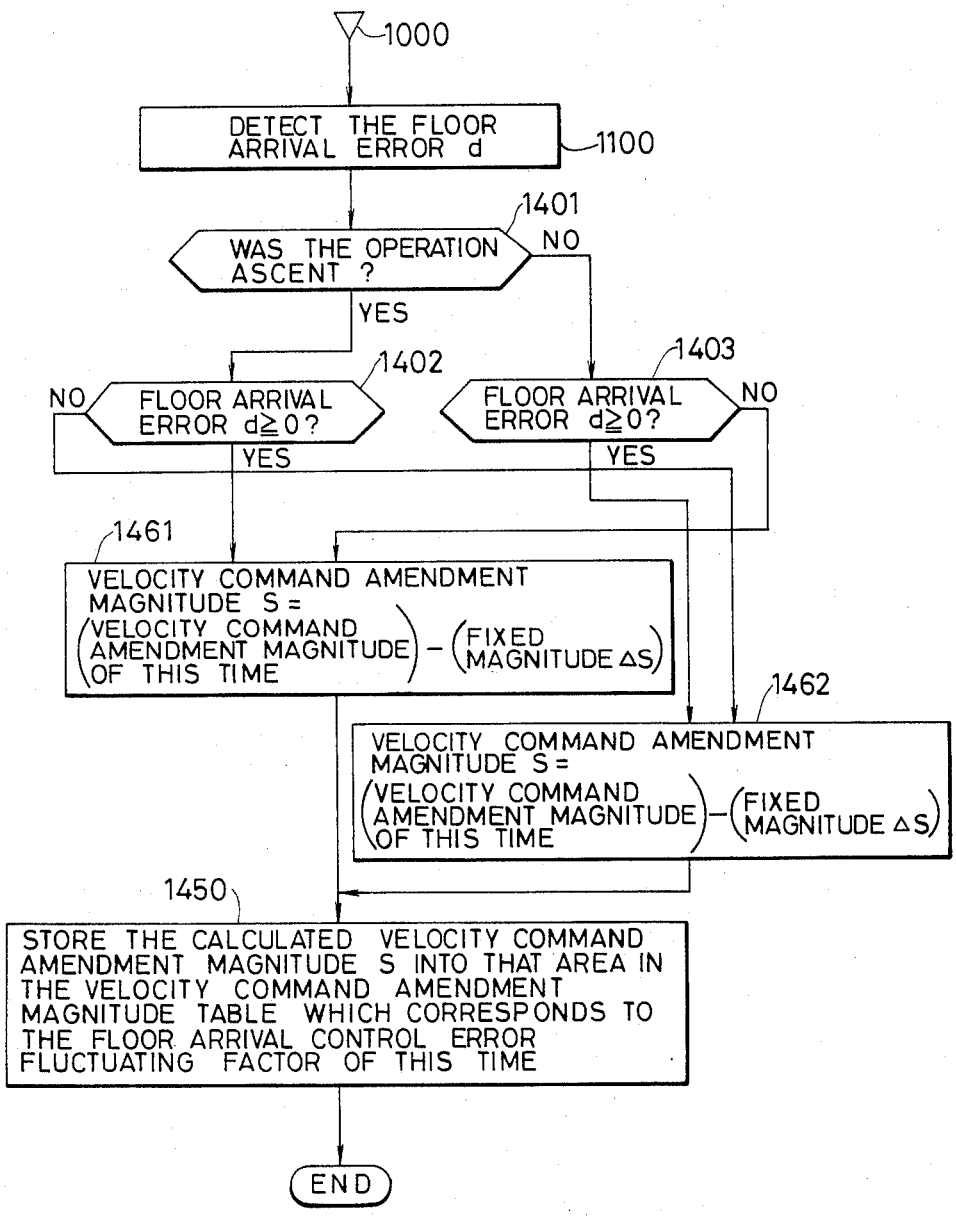

Another embodiment of the learning on the floor arrival error d in the present invention is shown in FIG. 21. In the aforementioned learning on the floor arrival error d, in order to faithfully reflect the magnitude of the floor arrival error d upon the velocity command amendment magnitude S of the subsequent operation, the velocity command amendment magnitude S has been calculated by multiplying the absolute value of the floor arrival error d by the constant k as indicated by Block 1404 or 1405 in FIG. 20 by way of example. In contrast, in the embodiment shown in FIG. 21, the velocity command amendment magnitude S is calculated by subtracting or adding a certain fixed magnitude Δirrespective of the magnitude of the floor arrival error d as indicated by Block 1461 or 1462.

The present embodiment has the advantage that the velocity command amendment magnitude S can be simply calculated. As another advantage, it is only required to detect if the cage has stopped beyond the scheduled stopping position, and the precision of the floor arrival error detection is not a considerable problem.

However, when the fixed magnitude ΔS in Block 1461 or 1462 in FIG. 21 is set at a large value, the velocity command amendment magnitude S might diverge without converging to a proper magnitude, and the value of ΔS cannot be made very large. Accordingly, a long time is sometimes required for the velocity command amendment magnitude S to converge to the proper magnitude.

Figure 22:
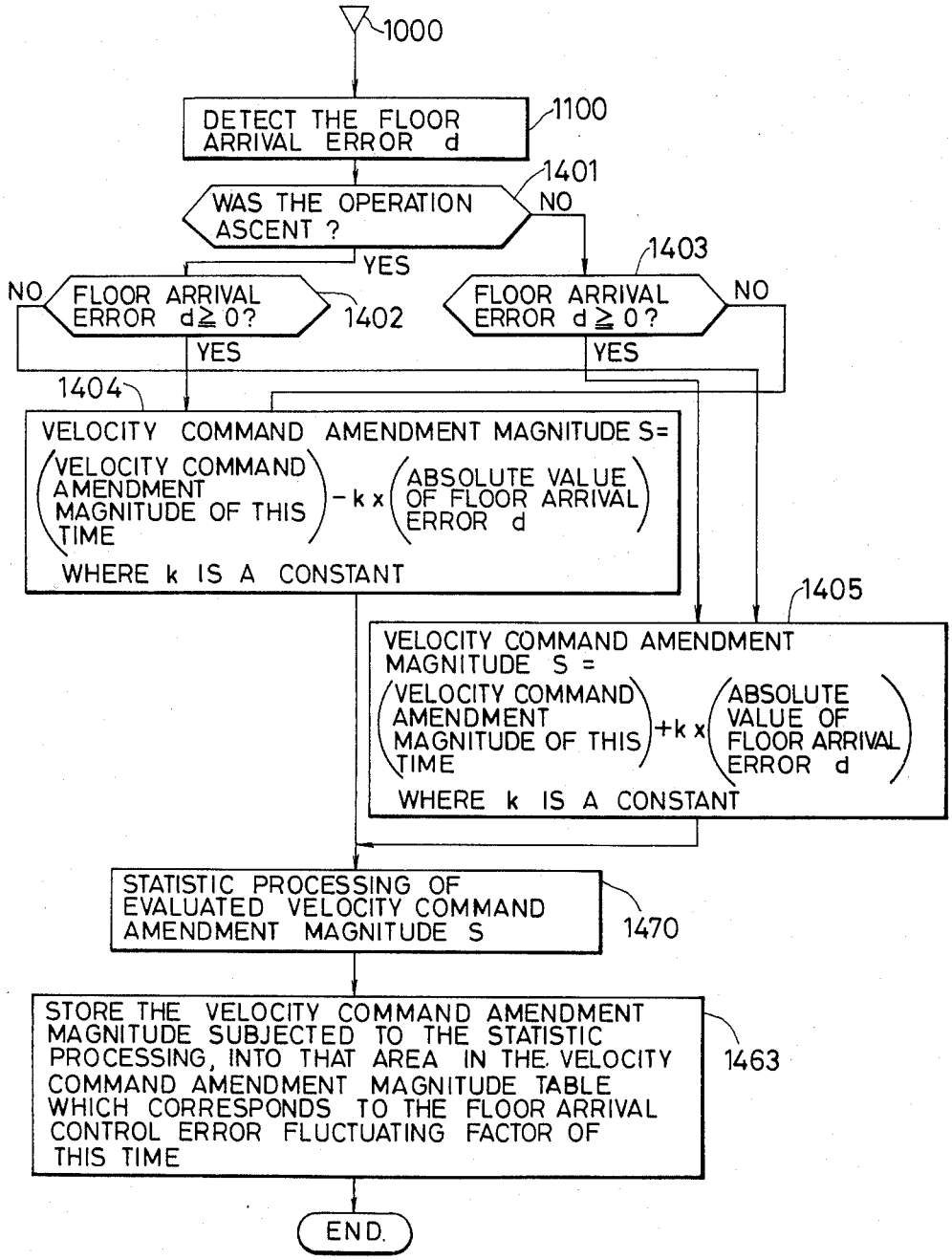
Figure 23:
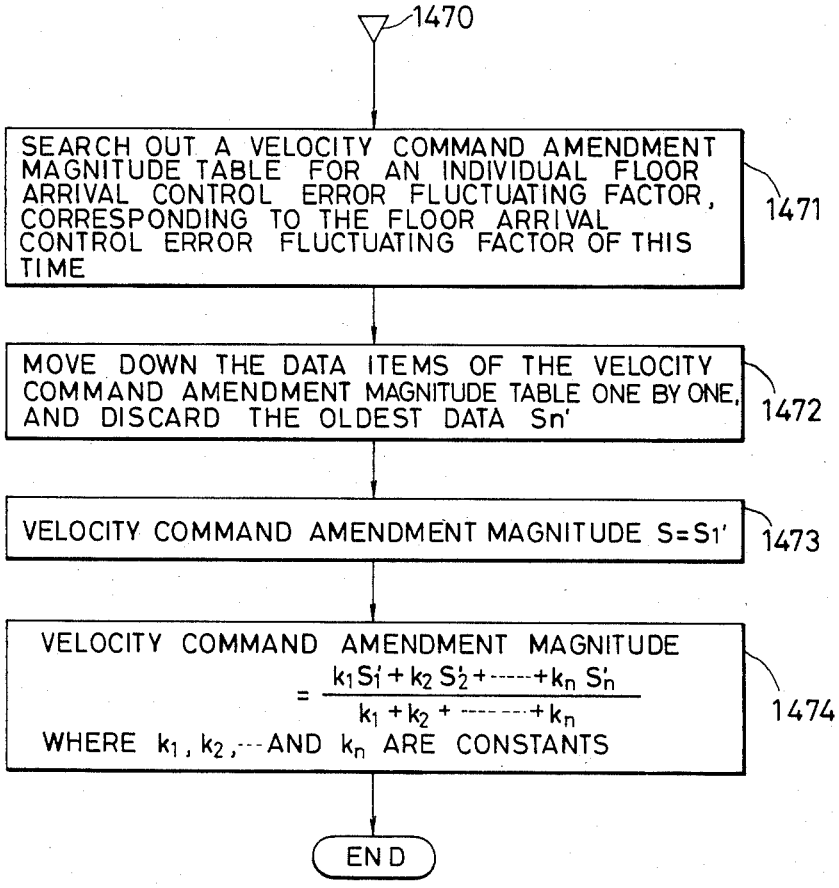
Figure 24:
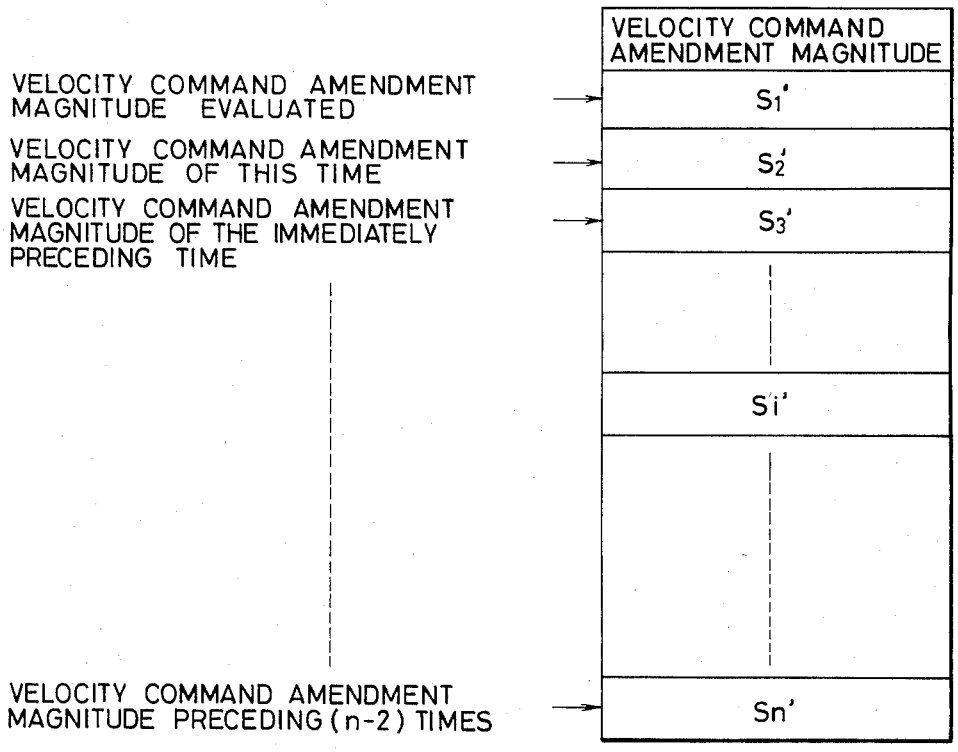

Another embodiment of the learning on the floor arrival error d in the present invention is shown in FIG. 22. In the foregoing embodiment, the velocity command amendment magnitude S is evaluated from one time of floor arrival error d detected. Therefore, even in a case where an exceptional result has arisen due to noise or the like, the control is greatly influenced by it. To the end of avoiding this drawback, there is considered a method in which a limit value is set for the floor arrival error d, and when it is exceeded, the velocity command amendment magnitude S is not amended. With this method, however, the setting of the limit value is difficult. Here, as a measure against such problem, it has been considered to subject the detected result or a value obtained therefrom, to statistic processing. The present embodiment consists in that the evaluated velocity command amendment magnitude S is subjected to the statistic processing as indicated by numeral 1470 in FIG. 22, thereby to diminish the influence of the exceptional result stated before. An example of the statistic processing of the velocity command amendment magnitude S is shown in FIG. 23. The expression "velocity command amendment magnitude table for an individual floor arrival control error fluctuating factor" in Block 1471 in the figure is a table which stores past velocity command amendment magnitudes S as to an identical floor arrival control error fluctuating factor as shown in FIG. 24. In the embodiment illustrated in FIG. 23, the velocity command amendment magnitude table for the individual floor arrival control error fluctuating factor is updated by Steps 1472 and 1473. As indicated by Block 1474, the velocity command amendment magnitude is evaluated from n data in the table. Assuming $k_1=k_2\ldots=k_n$ in Block 1474, the n data items are averaged, and assuming $k_1>k_2>\ldots>k_n$, the data closer to the present time is more weighted while the past data items are referred to.

Thus, the present embodiment has the advantage that the influence of the exceptional result upon the velocity command amendment magnitude S can be moderated. However, it requires a memory for storing past data for the individual floor arrival control error fluctuating factors.

Figure 25:
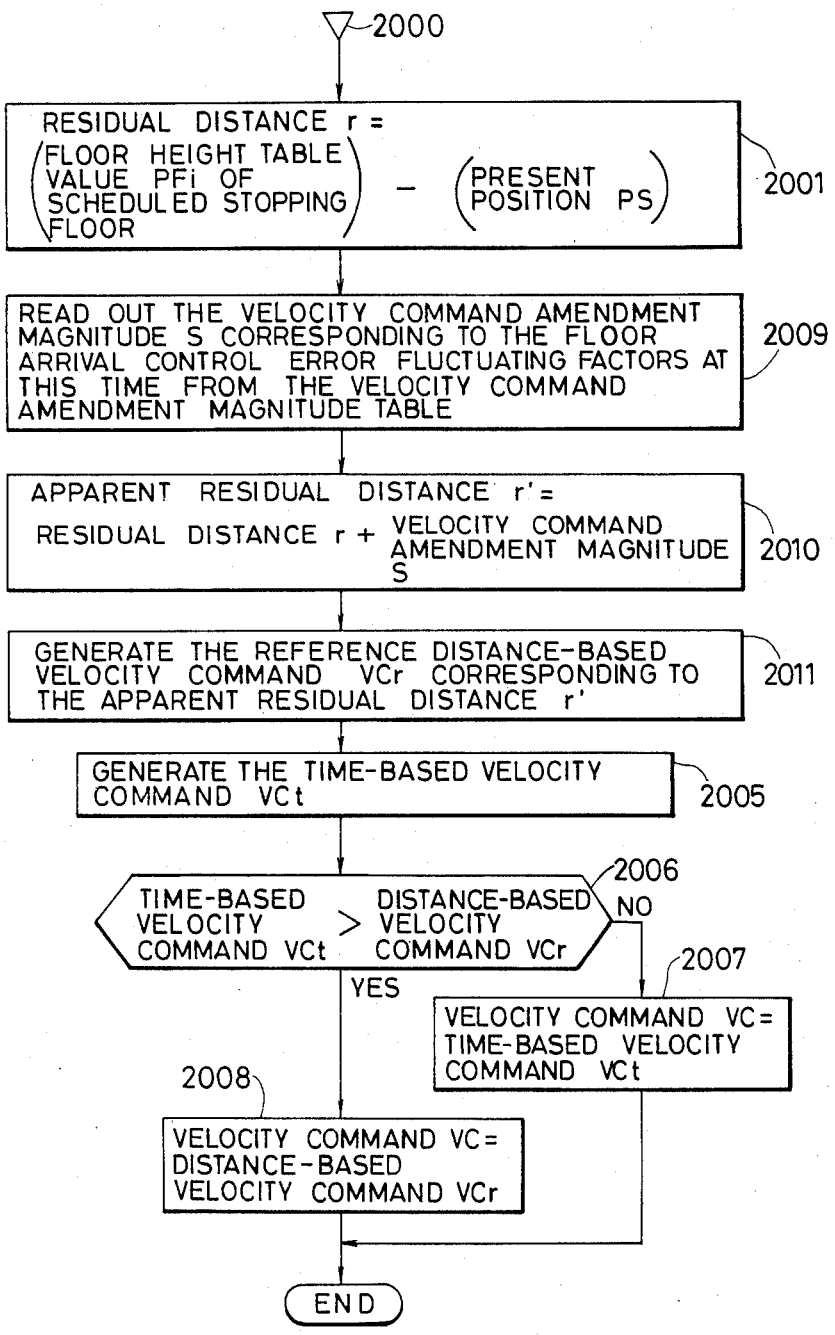

Another embodiment of the velocity command generation employing the velocity command amendment magnitude S is shown in FIG. 25. In the aforementioned learning on the floor arrival error d, the absolute value of the floor arrival error d has been multiplied by the constant k in order to calculate the velocity command amendment magnitude S. The reason is that, as illustrated in FIG. 19, the reference distance-based velocity command $VC_{r1}$ is directly amended with the velocity command amendment magnitude S, so the multiplication by k being the constant of the conversion from the distance (the absolute value of the floor arrival error) into the velocity (the distance-based velocity command) is needed. In this regard, in a case where the conversion constant k does not become an integer but becomes a real number having a decimal part, it degrades the efficiency to process the multiplication by means of a microprocessor itself.

The present embodiment therefore teaches the velocity command generation in which the dimension of the velocity command amendment magnitude S can be handled as the distance left intact without the multiplication by the conversion constant (in other words, the conversion constant $k=1$). In the embodiment shown in FIG. 25, the residual distance r is evaluated from the present position PS and the floor height table value $PF_i$ of the scheduled stopping floor, and an apparent residual distance r' is evaluated by adding the velocity command amendment magnitude S thereto as indicated by Blocks 2009 and 2010. As indicated by Block 2011, the distance-based velocity command $VC_r$ is calculated on the basis of the apparent residual distance r'. Thus, this distance-based velocity command $VC_r$ becomes a command for controlling the cage so as to stop at a point which is spaced from the regular scheduled stopping position by the velocity command amendment magnitude S corresponding to the floor arrival control error fluctuating factor.

According to the present embodiment described above, the calculation of the velocity command amendment magnitude S in the learning on the floor arrival error d can be simply processed.

Figure 27:
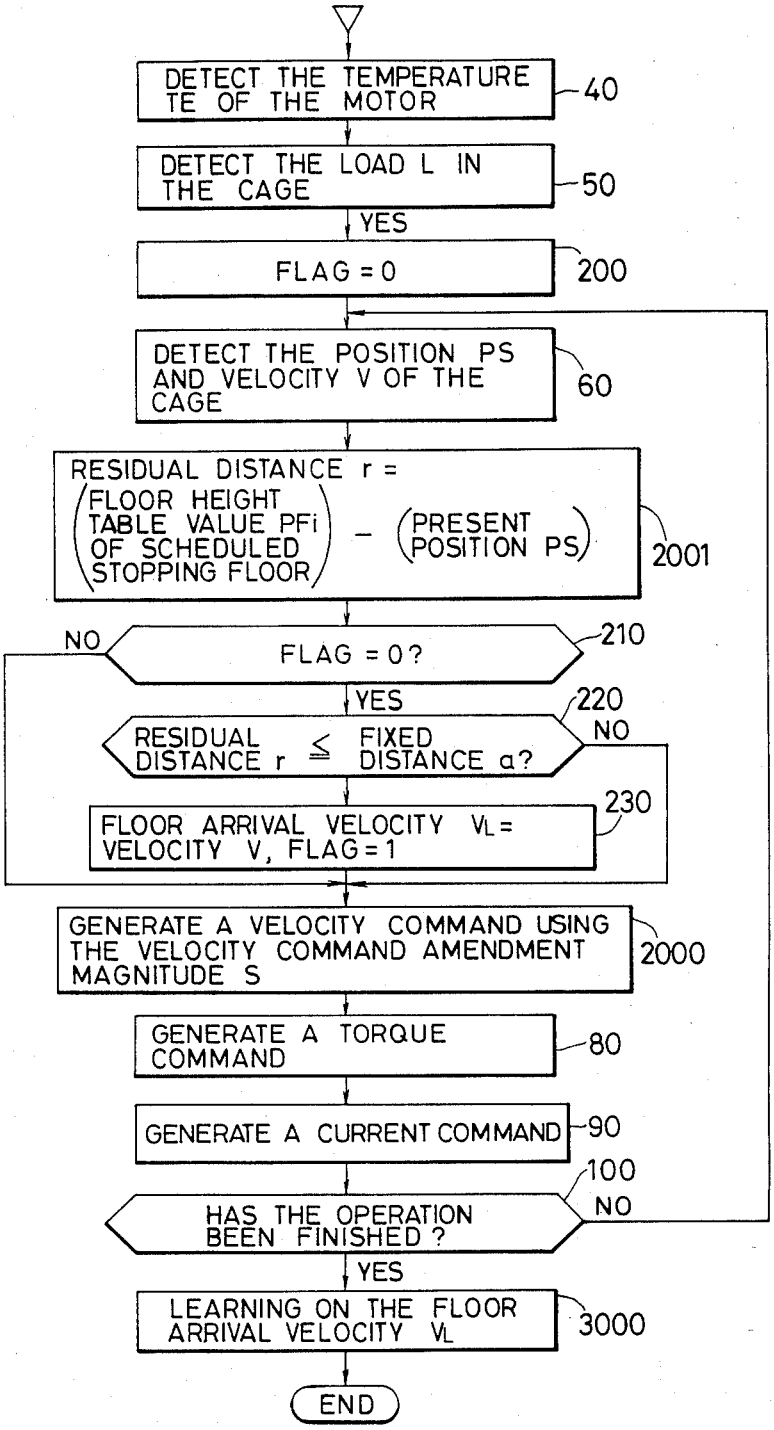
Figure 28:
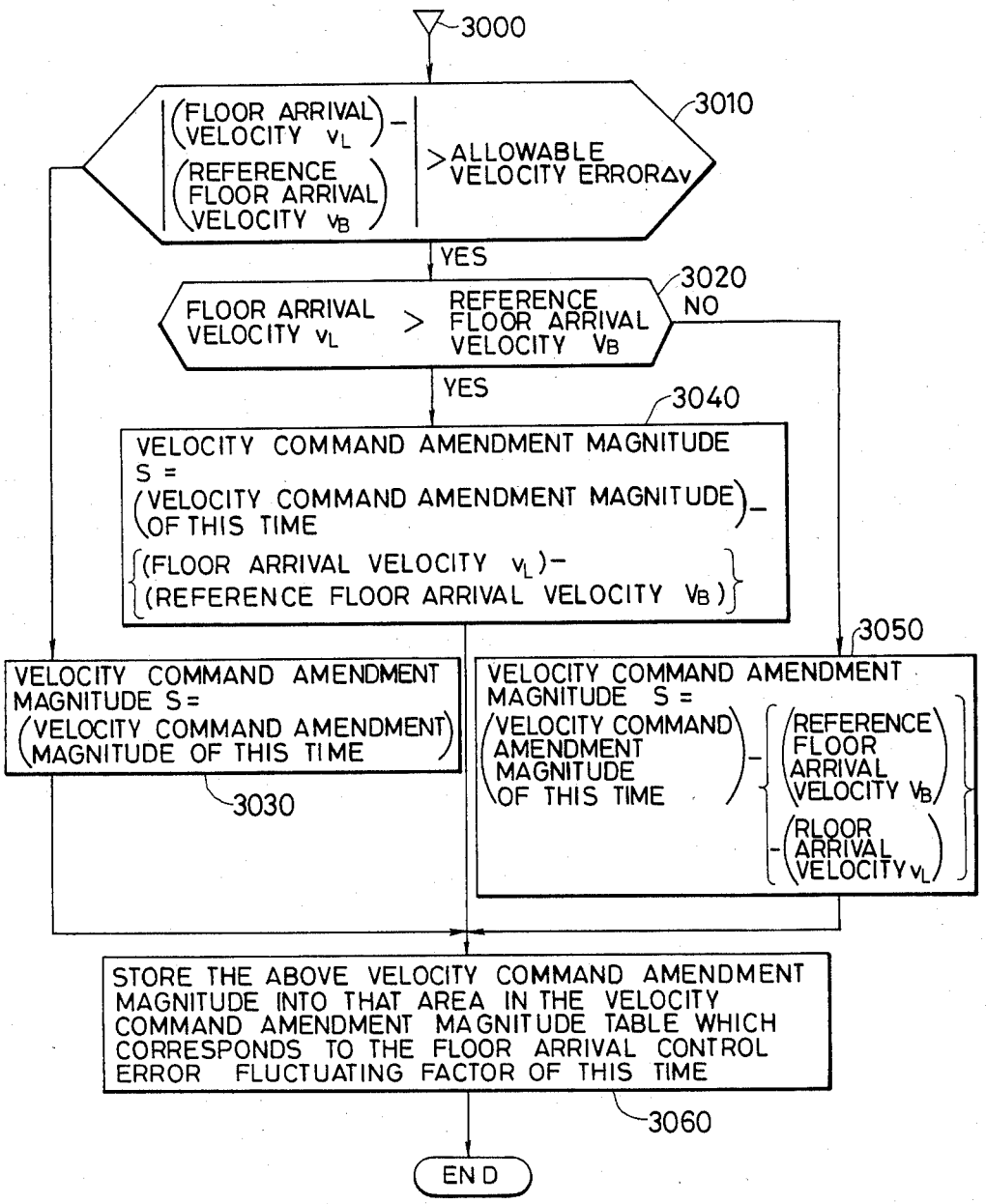

Another embodiment of the present invention is shown in FIGS. 27 and 28. In the foregoing embodiments, the floor arrival control error is judged from the floor arrival error, whereas in the present embodiment, it is judged from a velocity V at passage through a fixed point (hereinafter, termed "floor arrival velocity $V_L$").

Figure 26:
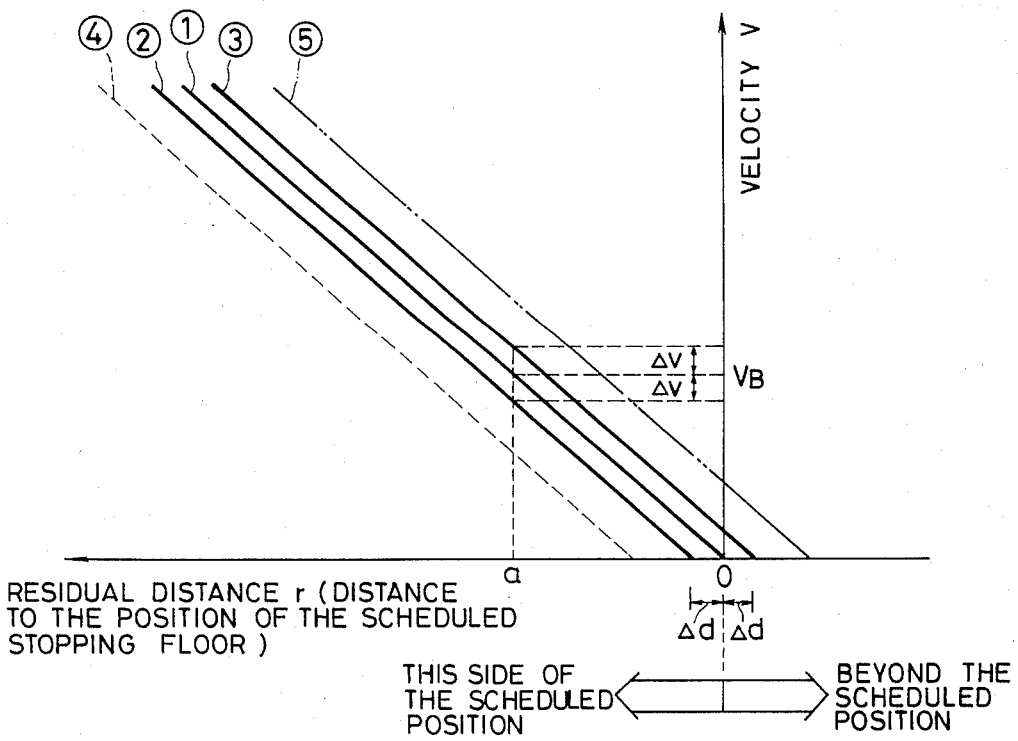

FIG. 26 shows the relationship between the residual distance r and the velocity V in the stopping operation. As illustrated in the figure, letting a reference floor arrival velocity $V_B$ be the velocity V at the fixed point a sufficiently close to that position of the scheduled stopping floor in the running operation at which the floor arrival error becomes zero, the floor arrival error lying within an allowable error $\Delta d$ ($d\geqq 0$) signifies that the floor arrival velocity $V_L$ at the fixed point a is:

$$V_B-\Delta v\leqq \text{floor arrival velocity } V_L\leqq V_B+\Delta v$$

(where $\Delta v$ is a value determined uniquely by $\Delta d$, and $\Delta v\geqq 0$ holds).

This value $\Delta v$ is therefore termed the "allowable velocity error", and the case of employing the floor arrival velocity $V_L$ will be explained below. As understood from the above relationship, ① in the figure indicates a reference floor arrival velocity curve, ② and ③ allowable floor arrival velocity curves, and ④ and ⑤ unallowable floor arrival velocity curves.

FIG. 27 shows the flow of CPU processing. The floor arrival velocity $V_L$ is detected by Steps 210, 220 and 230 in the figure. Next, the learning on the floor arrival velocity $V_L$ as indicated by Block 3000 in the figure is illustrated in detail in FIG. 28. In the learning on the floor arrival velocity $V_L$, as indicated at numeral 3010, the propriety of the velocity command amendment magnitude S employed in the operation of this time is judged depending upon whether or not the absolute value of the difference between the floor arrival velocity $V_L$ and the reference floor arrival velocity $V_B$ lies within the allowable velocity error $\Delta v$. In a case where the magnitude S has not been proper, the floor arrival velocity $V_L$ and the reference floor arrival velocity $V_B$ are compared as indicated by numeral 3020, to judge how the velocity command amendment magnitude S must be amended. Thereafter, the velocity command amendment magnitude S is amended as indicated by Block 3040 or 3050, and the result is stored into the velocity command amendment magnitude table as indicated by Block 3060.

According to the present embodiment described above, the floor arrival control error is judged from the velocity V at the passage through the fixed point, and there is the advantage that the position detector for the micro-operation is dispensed with. It is necessary, however, to set the fixed point for executing favorable learning.

Figure 30:
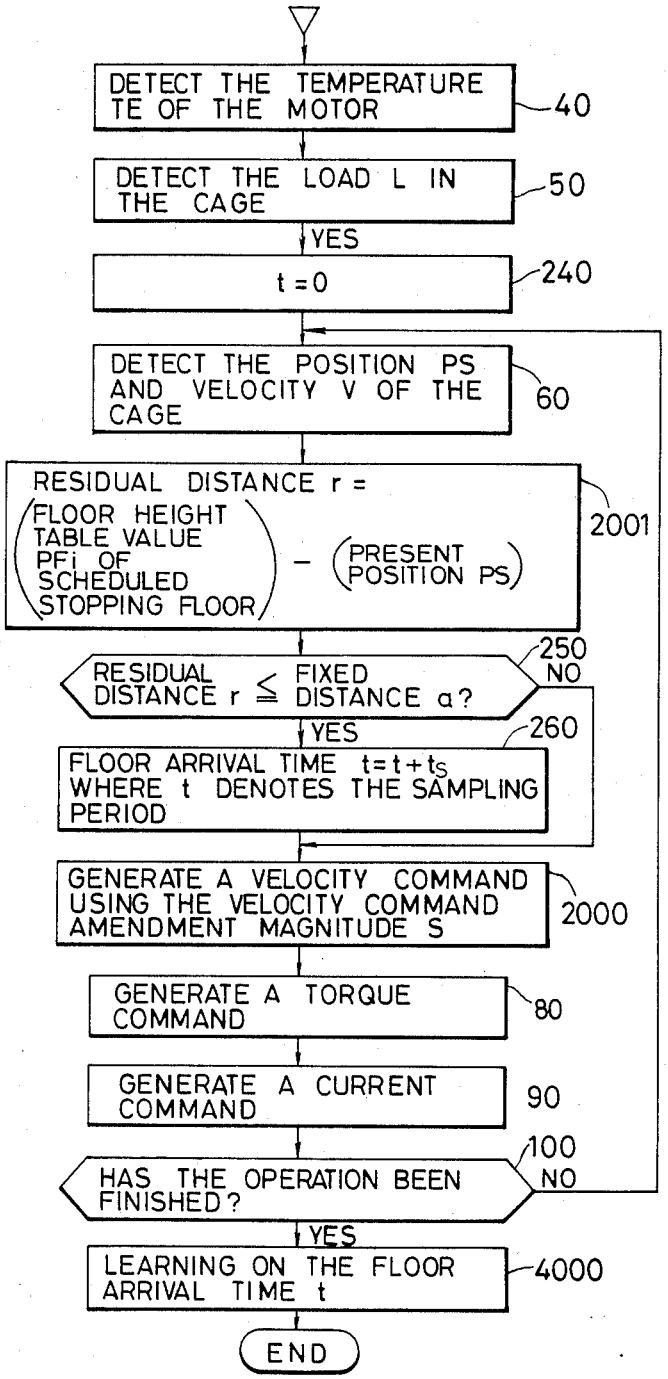
Figure 31:
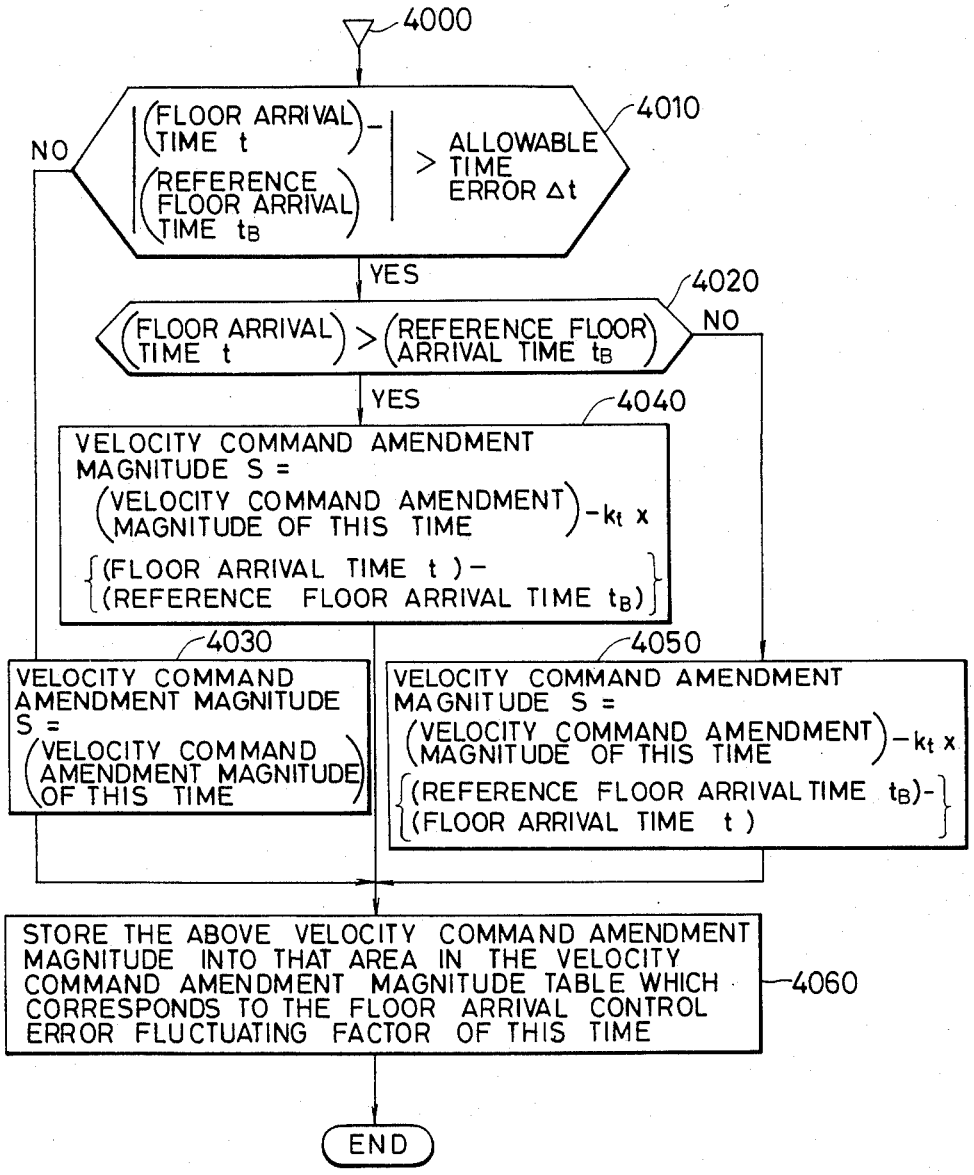

Another embodiment of the present invention is shown in FIGS. 30 and 31.

In the preceding embodiment, the floor arrival control error is judged from the floor arrival error d or the floor arrival velocity $V_L$, whereas in the present embodiment, it is judged from a period of time after the passage through a fixed point (hereinafter, termed "floor arrival time t").

Figure 29:
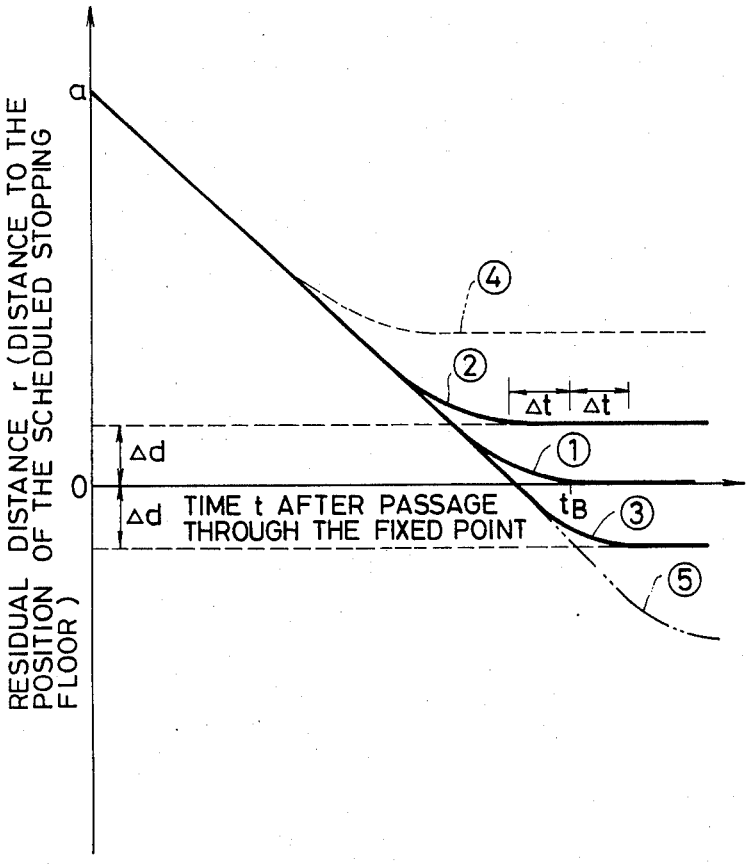

FIG. 29 shows the relationship between the period of time t after the passage through the fixed point a and the residual distance r in the stopping operation. As illustrated in the figure, letting a reference floor arrival time $t_B$ be a period of time required for the cage to stop since passing through the fixed point a sufficiently close to that position of the scheduled stopping floor in the running operation at which the floor arrival error becomes zero, the floor arrival error d lying within an allowable error $\Delta d$ ($\Delta d \geqq 0$) signifies that the floor arrival time t till the stoppage after the passage through the fixed point a is:

$$t_B - \Delta t \leqq \text{Floor arrival time } t \leqq t_B + \Delta t$$

(where $\Delta t$ is a value determined uniquely by $\Delta d$, and $\Delta t \geqq 0$ holds).

This value $\Delta t$ is therefore termed the "allowable time error", and the case of employing the floor arrival time t will be explained below. As understood from the above relationship, ① in the figure indicates a reference floor arrival time curve, ② and ③ allowable floor arrival time curves, ④ and ⑤ unallowable floor arrival time curves.

FIG. 30 shows the flow of CPU processing. The floor arrival time t is detected by Steps 250 and 260 in the figure. Next, the learning on the floor arrival time t as indicated by Block 4000 in the figure is illustrated in detail in FIG. 31. In the learning on the floor arrival time t, as indicated at numeral 4010, the propriety of the velocity command amendment magnitude S employed in the operation of this time is judged depending upon whether or not the absolute value of the difference between the floor arrival time t and the reference floor arrival time $t_B$ lies within the allowable time error $\Delta t$. In a case where the magnitude S has not been proper, the floor arrival time t and the reference floor arrival time $t_B$ are compared as indicated by numeral 4020, to judge how the velocity command amendment magnitude S must be amended. The velocity command amendment magnitude S is amended as indicated by Block 4040 or 4050. The velocity command amendment magnitude S evaluated here is stored into the velocity command amendment magnitude table as indicated by Block 4060.

According to the present embodiment described above, the floor arrival control error is judged from the period of time till the stoppage after the passage through the fixed point, and there is the advantage that the position detector for the micro-operation is dispensed with. Since, however, the precision of the floor arrival time t is determined by a sampling frequency $t_s$, a timer for exclusive use needs to be externally connected in order to raise the precision of the floor arrival time t when the sampling frequency $t_s$ is low.

Figure 32:
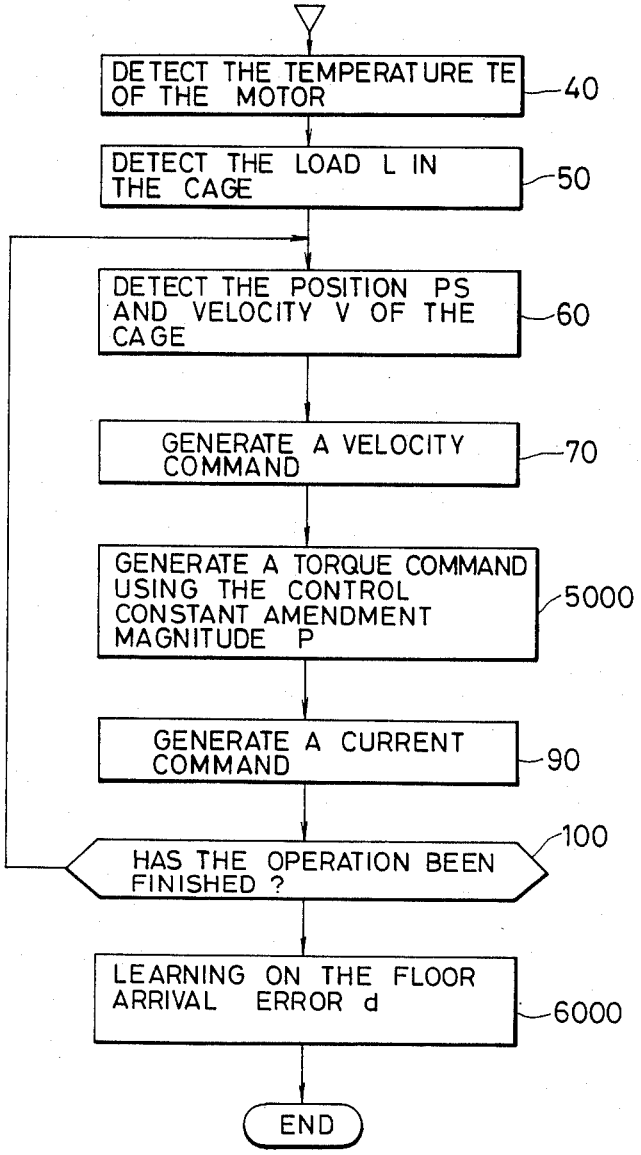
Figure 33:
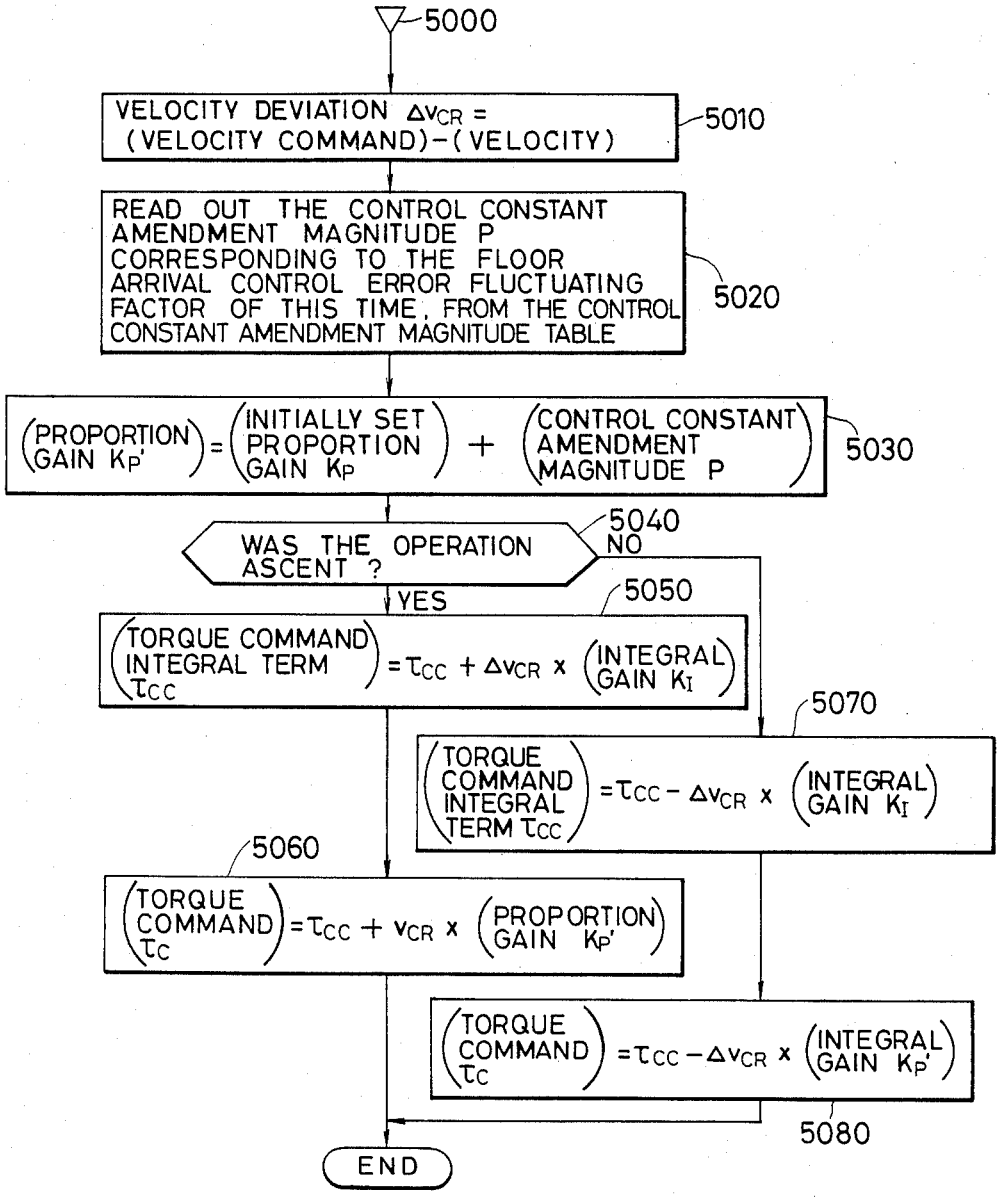

Another embodiment of the present invention will be described with reference to FIGS. 32 and 33.

In any of the preceding embodiments, the velocity command amendment magnitude S is evaluated from the floor arrival error d or the like and the result is reflected upon the velocity command of the subsequent operation, whereas the present embodiment evaluates a control constant amendment magnitude P on the basis of the floor arrival error d and reflects it upon a control element in the subsequent operation (here, a proportion gain $K_P$ in the generation of a torque command). The flow of CPU processing in this case is shown in FIG. 32.

Hereunder, the learning on the floor arrival error d and the torque command generation using the control constant amendment magnitude P indicated by Blocks 6000 and 5000 in the figure will be described in detail. In the learning on the floor arrival error d, the control constant amendment magnitude P is calculated instead of the velocity command amendment magnitude S on the basis of the floor arrival error d detected by a method similar to the method of the foregoing embodiment, to prepare a control constant amendment magnitude table. In the torque command generation using the control constant amendment magnitude P, a proportion gain $K_P'$ for control is amended using this control constant amendment magnitude P as indicated by Blocks 5020 and 5030 in FIG. 33. That is, the differences of the command following-up properties of the floor arrival control error fluctuating factors are compensated by amending the proportion gain $K_P$ with the control constant amendment magnitude P.

Therefore, according to the present embodiment, a favorable floor arrival precision is attained. Since, however, the control constant is altered in the present embodiment and the overshoot of the velocity, etc. can occur, care needs to be taken for the feeling of ride.

In the above, various embodiments have been mentioned and described. Further, in elevators into which a group supervisory system or the like is introduced, the activity rate in day units is substantially constant in many cases. In such cases, the temperature of the motor for driving the cage of the elevator can be equivalently expressed by time. Therefore, the time can also be handled as a floor arrival control error fluctuating factor instead of the motor temperature. Employing the time in place of the motor temperature in this manner has the merit that the sensor for detecting the motor temperature is dispensed with.

In addition, the temperature of the motor for driving the cage of the elevator can be obtained from the conduction time of current. Therefore, the conduction time can be handled as a floor arrival error fluctuating factor in place of the motor temperature. Also in this case, there is the merit that the sensor for detecting the motor temperature is dispensed with.

While the foregoing embodiments have been described as to the D.C. elevator, the invention can of course be similarly performed in the A.C. elevator and the hydraulic elevator as stated in the introductory part of this specification. In these cases, especially in the A.C. elevator, the effect of enhancing the floor arrival precision is remarkable, and in the hydraulic elevator, a sharp enhancement in the floor arrival precision can be expected by employing the temperature of oil as a floor arrival control error fluctuating factor.

We claim:

1. An elevator control apparatus comprising:

a motor for driving an elevator cage which serves a plurality of floors;

torque adjusting means for varying the torque produced by said motor in accordance with a control command based on the difference between a velocity command and an actual velocity of the elevator cage, the velocity command being used to control the stopping of the elevator cage over an entire time interval measured from a fixed time reference;

elevator supervisory means for observing generation of calls in the floors and the elevator cage to furnish a start command and to schedule a stopping floor in response to the observed call;

sensing means provided for detection of floor arrival control error fluctuating factors affecting the floor arrival control of the elevator cage; and motor control means receiving the start command, information of the scheduled stopping floor and output of said sensing means and providing the control command to said torque adjusting means, said motor control means having a processing unit and a memory unit for storing a program to control the operation of the processing unit and one or more of control values and control element constants, in which the memory unit stores a correction magnitude for modifying the control command in accordance with the floor arrival control error in the form of a correction magnitude table in which the floor arrival control error fluctuating factors are made parameters, and the processing unit is programmed to execute the following steps:

(a) after appearance of the start command, taking in the predetermined floor arrival control error fluctuating factors from said sensing means;

(b) reading out the correction magnitude from an area of the correction magnitude table designated by the sensed floor arrival control error fluctuating factors as the parameters and generating the control command modified by the read-out correction magnitude;

(c) providing the modified control command to said torque adjusting means;

(d) on the basis of observation of the travel of the elevator cage, returning to the step (b) to repeat the above mentioned operation during the travel of the elevator cage and advancing to the next step (e) when the elevator cage stops;

(e) detecting the floor arrival control error resulting from the travel of the elevator cage;

(f) obtaining a renewed correction magnitude by amending, on the basis of the detected floor arrival control error, the correction magnitude which has been used in modification of the control command for the travel of the elevator cage of the present time; and (g) rewriting the content of the area of the correction magnitude table designated in the step (b) by means of the renewed correction magnitude.

2. An elevator control apparatus according to claim 1, wherein the floor arrival control error in step (e) is detected as a difference in the distance between an actual position of the floor arrival of the elevator cage and a predetermined stopping position of the scheduled stopping floor.

3. An elevator control apparatus according to claim 1, wherein the floor arrival control error in step (e) is detected on the basis of the velocity of the elevator cage when the cage passes a point located at a predetermined distance before the scheduled stopping floor.

4. An elevator control apparatus according to claim 1, wherein the floor arrival control error in step (e) is detected on the basis of a period of time in which the elevator cage reaches a second point since the cage has passed a first point corresponding to the scheduled stopping floor.

5. An elevator control apparatus according to claim 1, wherein the correction magnitude table includes a plurality of tables, in each of which at least some of the floor arrival control error fluctuating factors are the parameters, for the respective floor arrival control error fluctuating factors, their degrees to which the floor arrival control error detected at step (e) is affected are analyzed respectively, the renewed correction magnitude in step (f) is obtained for the respective floor arrival control error fluctuating factors as analyzed above, and the thus obtained renewed correction magnitudes are written into designated areas of the corresponding table respectively.

6. An elevator control apparatus according to claim 5, wherein the floor arrival control error fluctuating factors include one or more of a load of the elevator cage, a scheduled stopping floor thereof, a running direction thereof, temperature of a cage driving device.

7. An elevator control apparatus according to claim 6, wherein the temperature of the cage driving device involves one of a factor concerning the temperature of said motor, and a factor concerning a temperature of oil in an elevator in which the cage is driven through the oil by said motor.

8. An elevator control apparatus according to claim 1, wherein the correction magnitude obtained on the basis of the detected floor arrival control error is onee stored in a storage means which can store the predetermined number of the correction magnitudes, when the number of the correction magnitudes to be stored exceeds the predetermined number, the storage means discards the oldest one of the stored correction magnitudes and stores the correction magnitude obtained according to the floor arrival control error resulting from the travel of the elevator cage obtained from the present operation time, and the renewed correction magnitude is obtained on the basis of the correction magnitudes stored in the storage means.

9. An elevator control apparatus according to claim 8, wherein the renewed correction magnitude is obtained as an average value of the correction magnitudes stored in the storage means.

10. An elevator control apparatus according to claim 8, wherein the renewed correction magnitude is obtained from a weighted average value of the correction magnitudes stored in the storage means.

11. An elevator control apparatus according to claim 10, wherein the correction magnitude obtained from operation cycles closer to the present time are weighted more heavily than from earlier operation cycles.

12. An elevator control apparatus according to claim 1, wherein the velocity command defines a relationship between a residual distance to the scheduled stopping floor and a velocity of the elevator cage, the correction magnitude is a value with the floor arrival control error converted into the distance, and the relationship of the residual distance to the velocity of the velocity command is corrected with the correction magnitude converted into the distance.

13. An elevator control apparatus according to claim 12, wherein an apparent residual distance is obtained on the basis of the actual residual distance and the floor arrival control error converted into the distance, and the velocity command is generated in accordance with the apparent residual distance.

14. An elevator control apparatus according to claim 1, wherein the velocity command defines a relationship between a residual distance to the scheduled stopping floor and a velocity of the elevator cage, the correction magnitude is a value with the floor arrival control error converted into the velocity, and the relationship of the velocity to the residual distance of the velocity command is corrected with the correction magnitude converted into the velocity.

15. An elevator control apparatus according to claim 1, wherein when the detected floor arrival control error exceeds the predetermined value, the renewed correction magnitude is obtained by amending with a certain fixed value the correction magnitude which has been used in modification of the control command for the travel of the elevator cage of the present time.

16. An elevator control apparatus according to claim 5, wherein some of the floor arrival control error fluctuating factors are selected in accordance with the degree to which the floor arrival control error detected at the step (e) is affected, and the correction magnitudes are obtained for the respective floor arrival control error fluctuating factors selected above.

17. An elevator control apparatus according to claim 5, wherein some of the floor arrival control error fluctuating factors are selected in accordance with the correction magnitudes which are obtained for the respective floor arrival control error fluctuating factors analyzed.

18. An elevator control apparatus comprising:

a motor for driving an elevator cage which serves a plurality of floors;

torque adjusting means for varying the torque produced by said motor in accordance with a control command based on the difference between a velocity command and an actual velocity of the elevator cage, the velocity command being used to control the stopping of the elevator cage over an entire time interval measured from a fixed time reference;

elevator supervisory means for observing generation of calls in the fllors and the elevator cage to furnish a start command and to schedule a stopping floor in response to the observed call;

sensing means provided for detection of floor arrival control error fluctuating factors affecting the floor arrival control of the elevator cage, the floor arrival control error fluctuating factors including one or more of a load of the elevator cage, a scheduled stopping floor thereof, a running direction thereof or temperature of a cage driving device; and motor control means receiving the start command, information of the scheduled stopping floor and outout of said sensing means and providing the control command to said torque adjusting means, said motor control means having a processing unit and a memory unit for storing a program to control the operation of the processing unit and one or more of control values and control element constants, in which the memory unit stores a correction magnitude for modifying the control command in accordance with the floor arrival control error in the form of a correction magnitude table in which the floor arrival control error fluctuating factors are made parameters, and the processing unit is programmed to execute the following steps:

(a) after appearance of the start command, taking in the predetermined floor arrival control error fluctuating factors from said sensing means;

(b) reading out the correction magnitude from an area of the correction magnitude table designated by the sensed floor arrival control error fluctuating factors as the parameters and generating the control command modified by the read-out correction magnitude;

(c) providing the modified control command to said torque adjusting means;

(d) on the basid of observation of the travel of the elevator cage, returning to the step (b) to repeat the above mentioned operation during the travel of the elevator cage and advancing to the next step (e) when the elevator cage stops;

(e) detecting the floor arrival control error resulting from the travel of the elevator cage;

(f) obtaining a renewed correction magnitude by amending, on the basis of the detected floor arrival control error, the correction magnitude which has been used in modification of the control command for the travel of the elevator cage of the present time; and (g) rewriting the content of the area of the correction magnitude table designed in the step (b) by means of the renewed correction magnitude.

* * * * *